US010935903B2

(12) United States Patent
Sugiyama et al.

(10) Patent No.: US 10,935,903 B2
(45) Date of Patent: Mar. 2, 2021

(54) DEVELOPING ROLLER, PROCESS CARTRIDGE AND IMAGE FORMING APPARATUS

(71) Applicant: CANON KABUSHIKI KAISHA, Tokyo (JP)

(72) Inventors: Ryo Sugiyama, Mishima (JP); Yuji Sakurai, Susono (JP); Kazutoshi Ishida, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 137 days.

(21) Appl. No.: 16/384,043

(22) Filed: Apr. 15, 2019

(65) Prior Publication Data

US 2019/0324382 A1 Oct. 24, 2019

(30) Foreign Application Priority Data

Apr. 19, 2018 (JP) ..... JP2018-080937

(51) Int. Cl.
*G03G 15/08* (2006.01)

(52) U.S. Cl.
CPC ..... *G03G 15/0815* (2013.01); *G03G 15/0808* (2013.01)

(58) Field of Classification Search
CPC ..... G03G 15/0808; G03G 15/0815
See application file for complete search history.

(56) References Cited

U.S. PATENT DOCUMENTS

| | | | |
|---|---|---|---|
| 6,725,002 | B2 | 4/2004 | Sakurai et al. |
| 7,201,967 | B2 | 4/2007 | Sakurai et al. |
| 7,798,948 | B2 | 9/2010 | Kawamura et al. |
| 7,979,004 | B2 | 7/2011 | Tanaka et al. |
| 8,600,273 | B2 | 12/2013 | Yamada et al. |
| 8,655,238 | B2 | 2/2014 | Uno et al. |
| 8,660,472 | B2 | 2/2014 | Kurachi et al. |
| 8,706,011 | B2 | 4/2014 | Anan et al. |
| 8,768,226 | B2 | 7/2014 | Koyanagi et al. |
| 8,774,677 | B2 | 7/2014 | Sakurai et al. |
| 8,798,508 | B2 | 8/2014 | Yamada et al. |
| 8,837,985 | B2 | 9/2014 | Ishida et al. |
| 8,846,287 | B2 | 9/2014 | Yamada et al. |
| 9,017,239 | B2 | 4/2015 | Ishida et al. |

(Continued)

FOREIGN PATENT DOCUMENTS

| | | |
|---|---|---|
| JP | H04-88381 | 3/1992 |
| JP | 2006-058671 | 3/2006 |
| JP | 2008-015075 | 1/2008 |

OTHER PUBLICATIONS

U.S. Appl. No. 16/280,201, Yuji Sakurai, filed Feb. 29, 2019.

*Primary Examiner* — Joseph S Wong
(74) *Attorney, Agent, or Firm* — Venable LLP

(57) ABSTRACT

The developing roller includes an electro-conductive substrate and a covering layer on the electro-conductive substrate, the covering layer including a matrix and an electro-conductive particle dispersed in the matrix, an arithmetic mean value of the current value is 300 pA or less and the standard deviation of the current value is 0.1-fold or less of the current value, a standard deviation of a potential is 3.0 V or more, and an arithmetic mean value of a volume resistivity is $10^{10}$ Ω·cm or less, and a standard deviation of the volume resistivity is 1-fold or more of the arithmetic mean value of the volume resistivity.

7 Claims, 5 Drawing Sheets

(56) References Cited

U.S. PATENT DOCUMENTS

| | | | | |
|---|---|---|---|---|
| 9,482,986 | B2 | 11/2016 | Sakurai et al. | |
| 9,921,518 | B2 | 3/2018 | Sakurai et al. | |
| 9,952,532 | B2 | 4/2018 | Sugiyama et al. | |
| 10,082,741 | B2 | 9/2018 | Ishida et al. | |
| 2005/0085361 | A1* | 4/2005 | Ishida | G03G 15/0808 492/56 |
| 2006/0067747 | A1 | 3/2006 | Matsuda et al. | |
| 2006/0226572 | A1 | 10/2006 | Tanaka et al. | |
| 2013/0130022 | A1 | 5/2013 | Uesugi et al. | |
| 2013/0164038 | A1 | 6/2013 | Kusaba et al. | |
| 2013/0266339 | A1 | 10/2013 | Sugiyama et al. | |
| 2016/0122611 | A1* | 5/2016 | Yoshida | C08L 83/04 252/75 |
| 2016/0187808 | A1* | 6/2016 | Kim | G03G 15/0822 399/279 |
| 2019/0018362 | A1 | 1/2019 | Morishita et al. | |

* cited by examiner

DEVELOPING ROLLER, PROCESS CARTRIDGE AND IMAGE FORMING APPARATUS

BACKGROUND OF THE INVENTION

Field of the Invention

The present disclosure relates to a developing roller, a process cartridge and an image forming apparatus.

Description of the Related Art

In recent years, image forming apparatuses such as copiers and optical printers have been increasingly reduced in size and saved in energy. One example of methods for reductions in the sizes of such image forming apparatuses includes a reduction in the diameter of each member such as a developing roller and a toner feed roller. One example of methods for saving of energy of such image forming apparatuses includes a reduction in the torque of each member in rotation and rubbing (a reduction in the amount of invasion and a reduction in the difference in circumferential speed of each member). However, reductions in the diameters of a developing roller and a toner feed roller, and a reduction in torque in rotation due to a reduction in the amount of invasion and a reduction in the difference in circumferential speed of each member may cause an insufficient amount of toner formed on the developing roller, resulting in no uniform image in some cases.

Japanese Patent Application Laid-Open No. H04-88381 discloses a developing roller that can allow an insulating particle dispersed in an electro-conductive elastomer to be partially exposed for an enhancement in the toner conveying force of a development member, to allow toner to electrically adsorb to the insulating particle charged, resulting in conveyance of the toner.

The developing roller described in Japanese Patent Application Laid-Open No. H04-88381 provides charging of an insulating portion due to the insulating particle exposed on the surface, resulting in the occurrence of a local potential difference between the insulating portion charged and an electro-conductive portion not charged. Such a local potential difference is present to result in the occurrence of an electric field gradient according to such a potential difference. Any article present in the electric field gradient has an excellent toner conveying force due to a force (gradient force) generated by the electric field gradient.

On the other hand, in recent years, image forming apparatuses have been demanded to be not only reduced in torque in rubbing, but also increased in the quality of an image formed by such image forming apparatuses. The present inventors have made studies and thus have found that a developing roller including the above insulating portion is varied in the potential generated by charging of the insulating portion, easily resulting in the occurrence of the change in image density.

That is, the potential of the insulating portion is varied with being more influenced by the potential of a photosensitive member in image formation and the changes in the states of toner and the insulating portion due to repeating of image formation. The change in the potential of the insulating portion leads to the change in the development electric field for image formation, resulting in an apparent change in image density. Accordingly, suppression of such an influence by the change in the potential of the insulating portion is an object to be accomplished for more stable image formation.

In order to suppress the change in image density according to the change of the potential of the insulating portion, it is, for example, considered to decrease the electrical resistance value of the insulating portion. In such a case, however, the amount of charging of the insulating portion may be insufficient to easily result in reduction in toner conveying force.

SUMMARY OF THE INVENTION

One aspect of the present disclosure is directed to providing a developing roller that enables a high toner conveying force and suppression of the change in image density to be simultaneously achieved. Another aspect of the present disclosure is directed to providing a process cartridge that contributes to formation of a high-quality electrophotographic image. Still another aspect of the present disclosure is directed to providing an electrophotographic apparatus that can form a high-quality electrophotographic image.

According to one aspect of the present disclosure, there is provided a developing roller including an electro-conductive substrate and a covering layer on the electro-conductive substrate, the covering layer including a matrix including a binder resin, and an electro-conductive particle dispersed in the matrix, wherein when a current value is measured with scanning of a measurement region of a square of 90 μm×90 μm on an outer surface of the covering layer in a tapping mode with application of a potential difference of 10 V in a thickness direction of the covering layer by a cantilever of a scanning probe microscope, the cantilever having a triangular pyramid-shaped tip, a radius of curvature of the tip of 25 nm and a constant of spring of 42 N/m, in an environment of a temperature of 23° C. and a relative humidity of 50%, an arithmetic mean value of the current value is 300 pA or less and a standard deviation of the current value is 0.1-fold or less the current value, wherein when the outer surface of the covering layer is charged by using a corona charger with scanning at a speed of 400 mm/sec in a longitudinal direction of the developing roller, with a potential difference of +8 kV being provided relative to the outer surface of the covering layer and a distance between the outer surface of the covering layer and the corona charger being 1 mm, in an environment of a temperature of 23° C. and a relative humidity of 50%, and since 1 minute after the charging, a potential is measured with scanning of a measurement region of a square of 99 μm×99 μm on the outer surface of the covering layer at a distance between the outer surface of the covering layer and a cantilever of a surface potential measurement apparatus of 5 μm, in an environment of a temperature of 23° C. and a relative humidity of 50%, a standard deviation of the potential is 3.0 V or more, and wherein when a stainless steel roller having a diameter of 30 mm and a width of 10 mm is located with a surface in a circumferential direction of the stainless steel roller and a surface in a circumferential direction of the developing roller being opposite to each other so as to allow an axial direction of the stainless steel roller to be perpendicular to an axial direction of the developing roller, and is allowed to abut at a load so that a pressure applied to the surface of the developing roller is 0.10 MPa, and a current value is measured by applying between the stainless steel roller and the electro-conductive substrate a potential difference of 10 V while rotating the stainless roller at a speed of 50 mm/sec in the axial direction of the developing roller, in an environment of a temperature of 23° C. and a relative humidity of 50%, at 36 points in the circumferential direction of the developing roller, an arithmetic mean value of a volume resistivity determined from the measured current value is $10^{10}$ Ω·cm or less, and a standard deviation of the volume resistivity is 1-fold or more of the arithmetic mean value of the volume resistivity.

According to another aspect of the present disclosure, there is provided a process cartridge configured to be detachable to a main body of an electrophotographic apparatus, wherein the process cartridge includes the developing roller.

According to still another aspect of the present disclosure, there is provided an electrophotographic image forming apparatus including a photosensitive member and a developing roller that feeds a developer to an electrostatic latent image formed on the photosensitive member, wherein the developing roller is the above developing roller.

Further features of the present disclosure will become apparent from the following description of exemplary embodiments with reference to the attached drawings.

DESCRIPTION OF THE EMBODIMENTS

Figure 1:
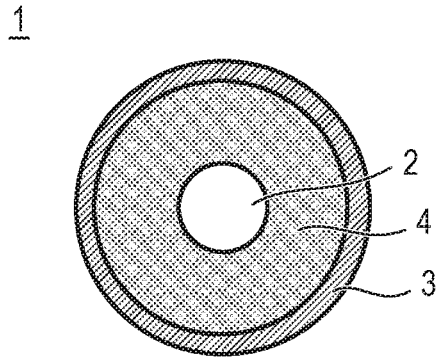
FIG. 1 is a cross-sectional view illustrating one embodiment of a developing roller according to the present aspect.

Preferred embodiments of the present disclosure will now be described in detail in accordance with the accompanying drawings.

A developing roller according to one aspect of the present disclosure includes an electro-conductive substrate and a covering layer on the electro-conductive substrate. The covering layer includes a matrix including a binder resin, and an electro-conductive particle dispersed in the matrix. Further, the developing roller has the following three characteristics.

Characteristic 1

When a current value is measured with scanning of a measurement region of a square of 90 μm×90 μm on an outer surface of the covering layer in a tapping mode with application of a potential difference of 10 V in the thickness direction of the covering layer by a cantilever of a scanning probe microscope, the cantilever having a triangular pyramid-shaped tip, a radius of curvature of the tip of 25 nm and a constant of spring of 42 N/m, in an environment of a temperature of 23° C. and a relative humidity of 50%, an arithmetic mean value of the measured current value is 300 pA or less, and the standard deviation of the measured current value is 0.1-fold or less of the measured current value.

Characteristic 2

When the outer surface of the covering layer is charged by using a corona charger with scanning at a speed of 400 mm/sec in the longitudinal direction of the developing roller, with a potential difference of +8 kV being provided relative to the outer surface of the covering layer and the distance between the outer surface of the covering layer and the corona charger being 1 mm, in an environment of a temperature of 23° C. and a relative humidity of 50%, and since 1 minute after the charging, a potential is measured with scanning of a measurement region of a square of 99 μm×99 μm on the outer surface of the covering layer at a distance between the outer surface of the covering layer and a cantilever of a surface potential measurement apparatus of 5 μm, in an environment of a temperature of 23° C. and a relative humidity of 50%, a standard deviation of the resulting potential is 3.0 V or more.

Characteristic 3

When a stainless steel roller having a diameter of 30 mm and a width of 10 mm is located with the surface in the circumferential direction of the stainless steel roller and the surface in the circumferential direction of the developing roller being opposite to each other so as to allow the axial direction of the stainless steel roller to be perpendicular to the axial direction of the developing roller, and is allowed to abut at a load so that a pressure applied to the surface of the developing roller is 0.10 MPa, and a current value is measured by applying between the stainless steel roller and the electro-conductive substrate a potential difference between the stainless steel roller and the electro-conductive substrate of 10 V while rotating the stainless steel roller at a speed of 50 mm/sec in the axial direction of the developing roller, in an environment of a temperature of 23° C. and a relative humidity of 50% at 36 points in the circumferential direction of the developing roller, an arithmetic mean value of the volume resistivity determined from the current value measured is $10^{10}$ Ω·cm or less, and the standard deviation of the volume resistivity is 1-fold or more of the arithmetic mean value of the volume resistivity.

The present inventors have found that a developing roller satisfying characteristics 1 to 3 above can allow suppression of the change in image density and a high toner conveying force to be simultaneously achieved at high levels. The present inventors have presumed that such simultaneous achievement is based on the following two reasons.

The first reason is because a gradient force is exerted on the outer surface of the covering layer in the developing roller according to the present aspect.

Satisfaction of characteristic 1 means that insulation properties are exhibited on substantially the entire surface of the covering layer in the developing roller according to the present aspect, or exhibited on the entire surface thereof in non-pressing or in extremely light pressing. In the present disclosure, the arithmetic mean value of the current value is 300 pA or less, thereby allowing insulation properties to be easily achieved. The standard deviation is 0.1-fold or less the current value, resulting in suppression of a site where any charge is partially leaked.

Satisfaction of characteristic 2 means that the covering layer is charged to result in the occurrence of a local potential difference. In the present disclosure, the standard deviation of the potential is 3.0 V or more, resulting in an excellent amount of toner conveyance. The standard deviation of the potential is more preferably 4.0 V or more, further preferably 5.0 V or more. A roller including such a covering layer is used as the developing roller, thereby allowing the outer surface of the covering layer to be rubbed with toner or the like and thus charged. Furthermore, a local potential difference accordingly occurs on the outer surface of the covering layer. Such a local potential difference is presumed to allow a gradient force to be exerted, resulting in an excellent toner conveying force.

The second reason is because conductive properties are exhibited in pressing of the developing roller according to the present aspect.

Satisfaction of characteristic 3 means that the covering layer, which exhibits insulation properties on the entire surface thereof in non-pressing or in extremely light pressing, exhibits conductive properties in pressing.

In the case of use of the developing roller in a contact developing manner, the covering layer receives pressing from a photosensitive member at a developing position where the photosensitive member abuts with the developing roller disposed opposite to the photosensitive member. In order to stabilize the abutment of the developing roller with the photosensitive member, a load corresponding to an abutment pressure of about 0.10 MPa is applied between the developing roller and the photosensitive member.

Characteristic 3 means that the developing roller according to the present aspect exhibits conductive properties due to pressing at the same pressure as the pressure applied to the developing roller and the photosensitive member.

It is considered that the developing roller thus exhibits conductive properties at a developing position to enable any charge on the surface charged of the covering layer to be offset, resulting in usual formation of a proper development electric field at the developing position. In the present disclosure, the arithmetic mean value of the volume resistivity can be $10^{10}$ Ω·cm or less, thereby allowing the change in development electric field to be suppressed at the developing position. In addition, the standard deviation can be 1-fold or more the arithmetic mean value of the volume resistivity, thereby allowing the covering layer to be more uniformly conducted in pressing. Accordingly, it is presumed that the change in development electric field can be suppressed and the change in image density can be suppressed even in the case of the change in potential of the outer surface of the covering layer, having insulation properties in non-pressing, due to the change of the state of toner, the change in environment and the like by repeated image formation.

The developing roller according to the present aspect is a developing roller where the outer surface of the covering layer has insulation properties in non-pressing (characteristic 1), the outer surface of the covering layer is charged to allow a local potential difference to occur on the surface (characteristic 2) and the outer surface of the covering layer is conducted in pressing (characteristic 3). Such characteristics are presumed to allow an excellent toner conveying force and suppression of the change in image density to be simultaneously achieved.

Figure 2:
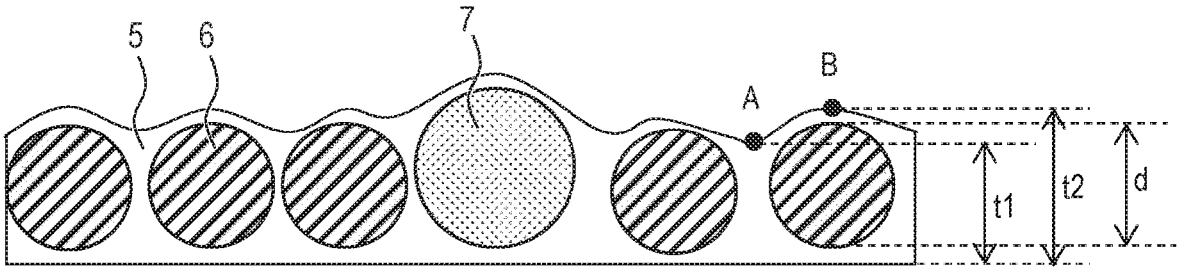
FIG. 2 is a cross-sectional view illustrating one embodiment of a covering layer in the present aspect.

One embodiment of the developing roller according to the present disclosure is here illustrated in FIG. 1. A developing roller 1 shown in FIG. 1 includes an electro-conductive substrate 2 and a covering layer 3 on the electro-conductive substrate 2. The developing roller according to the present aspect may further include at least one layer such as an electro-conductive elastic layer 4 between the substrate and the covering layer, as in the developing roller 1 illustrated in FIG. 1. Furthermore, an enlarged view of the cross section of the covering layer 3 in FIG. 1 is illustrated in FIG. 2.

The developing roller includes each configuration of the following requirements i) to ix), thereby more preferably exhibiting characteristics 1 to 3 above.

Requirement i) the potential decay time constant of the matrix is 1.0 minute or more in an environment of a temperature of 23° C. and a relative humidity of 50%;

Requirement ii) the electro-conductive particle has the mode value of the sphere volume-equivalent diameter of 3.0 μm or more and 20 μm or less;

Requirement iii) the proportion of the electro-conductive particle in the total volume of the covering layer is 20% by volume or more and 45% by volume or less;

Requirement iv) the covering layer has a thickness of 3.0 μm or more and 30 μm or less;

Requirement v) the electro-conductive particle, which is stacked in the thickness direction of the covering layer, has an arithmetic mean value of the number thereof of 3 or less;

Requirement vi) the nano-indenter hardness of the matrix on the outer surface of the covering layer is 0.1 $N/mm^2$ or more and 3.0 $N/mm^2$ or less in an environment of a temperature of 23° C. and a relative humidity of 50%;

Requirement viii) the nano-indenter hardness on the electro-conductive particle is 1.0 $N/mm^2$ or more and 10.0 $N/mm^2$ or less; and Requirement ix) the nano-indenter hardness on the electro-conductive particle is higher than the nano-indenter hardness of the matrix.

The mode value of the sphere volume-equivalent diameter of the electro-conductive particle dispersed in the matrix may preferably be 3.0 μm or more, and also the proportion of the volume of the electro-conductive particle in the total volume of the covering layer may preferably be 45% by volume or less, and the potential decay time constant of the matrix may preferably be 1.0 minute or more, thereby allowing characteristic 1 to be more favorably exhibited. The reason is presumed as follows.

Requirement i) above means that insulation properties are exhibited which enable charging of the outer surface of the covering layer, required for exerting of a toner conveying force of the developing roller, to be obtained. That is, it is meant that the matrix has insulation properties.

The mode value of the sphere volume-equivalent diameter of the electro-conductive particle described in requirement ii) above is from one to two orders of magnitude higher than the mode value of a general electroconductivity-imparting agent like carbon black. Thus, it is considered that the electro-conductive particle, when dispersed in the matrix, hardly causes any approaching to each other occurring along with aggregation or rearrangement of the electro-conductive particle, and any exposure on the surface and/or the interface of the electro-conductive particle. Thus, it is considered that the electro-conductive particle hardly causes formation of any conductive path even when dispersed in the matrix in an amount that allows the covering layer to exhibit high conductive properties in the case of an electroconductivity-imparting agent commonly used, the amount being a proportion of the volume of the electro-conductive particle in the entire covering layer of 45% by volume, described in requirement iii) above.

It is presumed from the above reason that a developing roller satisfying requirements i) to iii) above favorably exhibits the characteristic 1.

Requirements ii) to v) above can be satisfied to thereby allow the characteristic 2 to be more favorably exhibited. The reason is presumed as follows.

In FIG. 2, the thickness at an A point in the outer surface of the covering layer, in terms of an insulating layer, is designated as t1. The thickness at a B point, in terms of an insulating layer, corresponds to t2−d obtained by subtracting the particle size d of an electro-conductive particle 6 from the thickness t2 of the covering layer, and thus a local difference in thickness of the covering layer, in terms of an insulating layer, is present.

According to the Coulomb's law, the surface potential V in the case of the presence of charge Q on an insulator is defined as $V=Q/(\varepsilon \times S/a)$, where c represents the permittivity of the insulator, S represents the area of the insulator and a represents the thickness of the insulator. It is thus meant that, in the case where any charge is present on the surface of the insulator, the surface potential is in proportion to the thickness of the insulator.

That is, the covering layer in the present aspect exhibits insulation properties in non-pressing and the thickness thereof is locally different from the thickness thereof, in terms of an insulating layer, and thus it is considered that the covering layer, when charged due to rubbing or the like of the outer surface of the covering layer with toner, exhibits a local potential difference.

Requirements ii) and iii) above may preferably be satisfied to thereby allow the covering layer to be increased in a local difference in thickness, in terms of an insulating layer. Thus, a local potential difference described in the characteristic 2, for exerting of an excellent toner conveying force, namely, a gradient force, is easily exerted.

Furthermore, requirement iii) may preferably be satisfied because not only insulation properties of the covering layer in non-pressing can be kept, but also a matrix having a volume equal to or more than a certain level can be present, thereby imparting a local difference in thickness, in terms of an insulating layer.

Furthermore, requirement v) may preferably be satisfied to thereby easily impart a local difference in thickness onto the covering layer. Such a difference is presumed to be imparted by averaging the thickness of the covering layer, in terms of an insulating layer, along with stacking of the electro-conductive particle at a large number in the thickness direction of the covering layer, to thereby decrease such a local difference. Herein, the electro-conductive particle has an arithmetic mean value of the number thereof stacked in the thickness direction of the covering layer, the arithmetic mean value being able to be controlled by the thickness of the covering layer, the mode value of the sphere volume-equivalent diameter of the electro-conductive particle, the proportion of the volume of the electro-conductive particle in the entire covering layer, and the like.

While the change in thickness of the covering layer, as in t1 and t2, occurs due to the presence of the electro-conductive particle as illustrated in FIG. 2, the arithmetic mean value of any thickness measured randomly without any distinguishing of t1 and t2 is defined as the thickness of the covering layer in the present aspect, as described below.

Furthermore, requirements ii) to iv) and requirements vi) to xi) are satisfied to thereby allow the characteristic 3 to be more favorably exhibited. The reason is presumed as follows.

A low nano-indenter hardness of the matrix, namely, flexibility is presumed to result in easy deformation of the matrix in pressing of the covering layer. The nano-indenter hardness on the electro-conductive particle strongly reflects the hardness of the electro-conductive particle. It is considered that a higher nano-indenter hardness on the electro-conductive particle, and a higher nano-indenter hardness of the matrix, namely, the electro-conductive particle being harder than the matrix allow the covering layer to be pressed, and allow deformation of the electro-conductive particle to be suppressed in deformation of the matrix. It is presumed that the covering layer is pressed in such conditions to thereby allow the outer surface of the covering layer and the electro-conductive particle, the electro-conductive particle adjacent in the covering layer, and the electro-conductive particle and an electro-conductive substrate to approach to each other, resulting in conducting of the covering layer.

It is also considered that the proportion of the volume of the electro-conductive particle in the entire covering layer is 20% by volume or more to thereby easily allow for the occurrence of approaching with the electro-conductive particle being interposed.

Furthermore, requirements ii) and iv) are satisfied to thereby enable an excellent toner conveying force and suppression of the change in image density to be simultaneously achieved.

That is, the reason is considered because requirement ii) is satisfied to thereby allow a region conducted on the outer surface of the covering layer in pressing to be finer. It is presumed that use of a general toner for use in a copier or the like, having an average particle size of about several micrometers, can provide a finer interval of the electro-conductive particle exhibiting conductive properties in pressing to result in suppression of the change in image density, provided that the mode value of the sphere volume-equivalent diameter of the electro-conductive particle is 20 μm or less. Such fineness in the region conducted can be represented by an electro-conductive point density in pressing, as calculated according to a measurement method described below.

The electro-conductive point density in the pressing is preferably 10 points/100 μm□, more preferably 15 points/100 μm□ or more, further preferably 20 points/100 μm□ or more, because the change in image density is easily suppressed.

Furthermore, requirement iv) is satisfied to thereby easily allow the electro-conductive particle to be decreased in the arithmetic mean value of the number thereof stacked in the thickness direction of the covering layer and easily provide an excellent toner conveying force, in the case where the mode value of the sphere volume-equivalent diameter of the electro-conductive particle is 20 μm or less.

Hereinafter, a developing roller according to one aspect of the present disclosure will be described in detail.

[Developing Roller]

The developing roller includes an electro-conductive substrate and a covering layer as the outermost layer on the electro-conductive substrate. The developing roller may further include, if necessary, at least one layer such as an electro-conductive elastic layer 4 between an electro-conductive substrate 2 and a covering layer 3 as in illustrated in FIG. 1.

<Substrate>

The substrate can have conductive properties, and has the function of supporting a covering layer and an electro-conductive elastic layer provided thereon. Examples of the material of the substrate can include metals such as iron, copper, aluminum and nickel; and alloys including such any metal, such as stainless steel, duralumin, brass and bronze. Such materials may be used singly or in combinations of two or more thereof. The surface of the substrate can be plated for the purpose of imparting of scratch resistance, as long as conductive properties are not impaired. An additional substrate that can be used is also a substrate having an electro-conductive surface by covering of the surface of a base material such as a resin with a metal or a substrate produced from an electro-conductive resin composition.

<Covering Layer>

The covering layer includes a matrix including a binder resin and an electro-conductive particle dispersed in the matrix.

In the case where an electro-conductive elastic layer is provided between the substrate and the covering layer, the thickness of the covering layer is preferably 3.0 μm or more and 30 μm or less, more preferably 5.0 μm or more and 15 μm or less. The thickness is 3.0 μm or more to thereby allow a local difference in thickness, in terms of an insulating layer, to be easily provided on the outer surface of the covering layer, as described above. The thickness is 30 μm or less to thereby allow the electro-conductive particle to be easily decreased in the arithmetic mean value of the number thereof stacked in the thickness direction of the covering layer, easily resulting in an excellent toner conveying force. The thickness of the covering layer corresponds to the value measured according to a method described below.

The matrix includes a binder resin. As illustrated in FIG. 2, a matrix 5 constitutes an electro-conductive particle 6 in the covering layer 3, and a region not including any insulating particle 7 described below.

The matrix preferably has a potential decay time constant of 1.0 minute or more at a temperature of 23° C. and a relative humidity of 50% because the outer surface of the covering layer is easily charged and conveyance properties of toner are enhanced. The potential decay time constant is more preferably 5.0 minutes or more, further preferably 10 minutes or more. The potential decay time constant corresponds to the value measured according to a method described below.

The volume resistivity of the matrix is preferably $1.0\times10^{13}$ Ω·cm or more because the potential decay time constant is easily designed so as to be 1.0 minute or more. The volume resistivity is preferably $1.0\times10^{14}$ Ω·cm or more, more preferably $1.0\times10^{15}$ Ω·cm or more, still more preferably $1.0\times10^{16}$ Ω·cm or more. The upper limit of the volume resistivity is not particularly limited, and can be, for example, $1.0\times10^{19}$ Ω·cm or less. Each volume resistivity of the matrix and an electro-conductive particle described below can be measured by, for example, an atomic force microscope (AFM).

A specific measurement example of the volume resistivity is here represented.

An atomic force microscope (AFM) (trade name: Q-scope 250, manufactured by Quesant Instrument Corporation) is used for measurement in an electro-conductive mode. The covering layer of the developing roller is cut out into a sheet shape with a microtome so that the two surfaces of the electro-conductive particle, opposite to each other, are exposed, thereby providing a measurement piece. One surface of the measurement piece cut out is subjected to platinum vapor deposition. ADC power source (trade name: 6614C, manufactured by Agilent Technologies, Inc.) is then connected to the surface subjected to platinum vapor deposition to apply a volume of 10 V, and a free end of a cantilever is connected to another surface of the measurement piece, thereby resulting a current image through the main body of AFM. The measurement conditions are represented below.

Measurement mode: contact
Cantilever: CSC 17
Measurement region: 10 nm×10 nm
Scanning rate: 4 Hz
Voltage applied: 10 V
Measurement environment: temperature: 23° C.; relative humidity: 50%

The measurement is performed at 100 positions randomly selected. The volume resistivity is calculated from the average current value at the top ten positions where a lower current value is obtained, and the average thickness of the measurement piece and the contact area of the cantilever. In the case of an electro-conductive particle having a surface covered with an electro-conductive substance, the volume resistivity is calculated from the average current value on the surface of the particle. The average thickness of the measurement piece is defined as the average value obtained from observation of the cross section of the measurement piece cut out, at 10 positions in total, with an optical microscope or an electron microscope.

The nano-indenter hardness of the matrix is preferably 0.1 $N/mm^2$ or more and 3.0 $N/mm^2$ or less because the matrix can be sufficiently deformed in pressing of the covering layer and conductive properties are easily exhibited by approaching of the electro-conductive particle. The nano-indenter hardness of the matrix can be controlled by the molecular structure of the binder resin and an additive such as silica described below. The nano-indenter hardness can be herein measured according to a method described below.

(Binder Resin)

The binder resin included in the matrix is not particularly limited as long as the volume resistivity and the nano-indenter hardness can satisfy respective suitable ranges. Examples of such a binder resin include a polyurethane resin, polyamide, a urea resin, polyimide, a fluororesin, a phenol resin, an alkyd resin, a silicone resin, polyester, ethylene-propylene-diene-copolymerized rubber (EPDM), acrylonitrile-butadiene rubber (NBR), chloroprene rubber (CR), natural rubber (NR), isoprene rubber (IR), styrene-butadiene rubber (SBR), fluororubber, silicone rubber and a hydrogenated product of NBR. Such resins can be, if necessary, used singly or in combinations of two or more thereof. In particular, a polyurethane resin is preferable because such a resin is excellent in electrical insulation properties and flexibility and has high wear resistance required for the developing roller. Examples of the polyurethane resin include an ether-based polyurethane resin, an ester-based polyurethane resin, an acrylic polyurethane resin, a polycarbonate-based polyurethane resin and a polyolefin-based polyurethane resin. In particular, a polycarbonate-based polyurethane resin and a polyolefin-based polyurethane resin are preferable which easily impart electrical insulation properties and flexibility.

In particular, the binder resin more preferably has any one of or both structures represented by the following formulae (1) and (2), any one of or both structures represented by the following formulae (3) and (4), and a structure represented by the following formula (5) because a higher toner conveying force is obtained even in a high-temperature and high-humidity environment and the change in image density can be more suppressed even in a low-temperature and low-humidity environment.

Formula (1)

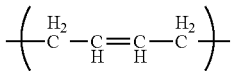

Formula (2)

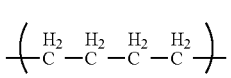

Formula (3)

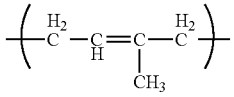

-continued

Formula (4)

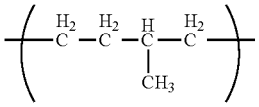

Formula (5)

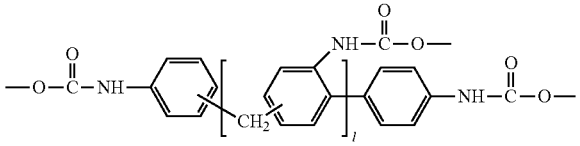

In formula (5), 1 represents an integer of 1 or more, and preferably represents an integer of 10 or more. The upper limit of 1 is not particularly limited, and can be, for example, an integer of 100 or less. While the reason why the following effect is exerted is still being tried to be figured out: the binder resin has such structures to thereby enable a higher toner conveying force to be obtained even in a high-temperature and high-humidity environment and enable the change in image density to be more suppressed even in a low-temperature and low-humidity environment; it is presumed by the present inventors as follows.

The structures represented by formulae (1) to (4) are low in polarity. Thus, it is considered that, while flexibility is increased to a hardness necessary for compressive deformation in pressing, namely, a nano-indenter hardness of 3.0 $N/mm^2$ or less, penetration of moisture in the environment, into the resin, can be suppressed and higher electrical insulation properties can be maintained even in a high-temperature and high-humidity environment.

The structures represented by formulae (3) and (4) have a methyl group in a side chain. It is considered that such a group can serve as steric hindrance to result in a reduction in crystallinity of the binder resin, in particular, suppression of an increase in hardness of the binder resin in a low-temperature and low-humidity environment.

It is presumed from the above that the binder resin has any one of or both the structures represented by formulae (1) and (2), any one of or both the structures represented by formulae (3) and (4), and the structure represented by formula (5) to thereby enable a high toner conveying force in a high-temperature and high-humidity environment and further suppression of the change in image density in a low-temperature and low-humidity environment to be simultaneously achieved.

In order that the structure represented by formula (1) is introduced into the binder resin, for example, a polybutadiene polyol having the structure represented by formula (1) in the molecule can be used as a raw material. The weight average molecular weight of the polybutadiene polyol is preferably 500 or more and 5000 or less. Examples of a commercially available product include "G-1000", "G-2000" and "G-3000" (all are trade names, manufactured by Nippon Soda Co., Ltd.), "Poly ip" (trade name, manufactured by Idemitsu Kosan Co., Ltd.), and "krasol LBH-2000" and "krasol LBH-P-3000" (all are trade names, manufactured by Cray Valley). Such products may be used singly or in combinations of two or more thereof.

In order that the structure represented by formula (2) is introduced into the binder resin, for example, a hydrogenerated polybutadiene polyol having the structure represented by formula (2) in the molecule can be used as a raw material. The weight average molecular weight of the hydrogenerated polybutadiene polyol is preferably 500 or more and 5000 or less. Examples of a commercially available product include "GI-1000", "GI-2000" and "GI-3000" (all are trade names, manufactured by Nippon Soda Co., Ltd.), and "krasol HLBH-P 2000" and "krasol HLBH-P 3000" (all are trade names, manufactured by Cray Valley). Such products may be used singly or in combinations of two or more thereof.

In order that the structure represented by formula (3) is introduced into the binder resin, for example, a polyisoprene polyol having the structure represented by formula (3) in the molecule can be used as a raw material. The weight average molecular weight of the polyisoprene polyol is preferably 500 or more and 5000 or less. Examples of a commercially available product include "Poly ip" (trade name, manufactured by Idemitsu Kosan Co., Ltd.). Such a product may be used singly or in combinations of two or more thereof.

In order that the structure represented by formula (4) is introduced into the binder resin, for example, a hydrogenerated polyisoprene polyol having the structure represented by formula (4) in the molecule can be used as a raw material. The weight average molecular weight of the hydrogenerated polyisoprene polyol is preferably 500 or more and 5000 or less. Examples of a commercially available product include "Epol" (trade name, manufactured by Idemitsu Kosan Co., Ltd.). Such a product may be used singly or in combinations of two or more thereof.

In order that the structure represented by formula (5) is introduced into the binder resin, for example, a polymeric MDI (polymethylene polyphenyl polyisocyanate) blocked by MEK oxime (2-butanone oxime) represented by the following formula (6) can be used as a raw material.

Formula (6)

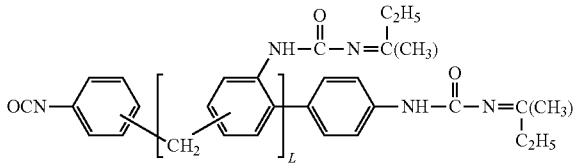

In formula (6), L represents an integer of 1 or more. The upper limit of L is not particularly limited, and can be, for example, an integer of 100 or less and is preferably an integer of 50 or less. The polymeric MDI is used to thereby suppress an excessive reaction of an isocyanate group, resulting in an enhancement in stability of a coating liquid. A prepolymer chain-extended by polyol in advance may also be used.

The binder resin can be obtained by, for example, reacting a mixture of a polyol including any one of or both the following a) and b) and any one of or both the following c) and d), and a polyisocyanate including the following e).

a) any one of or both a compound including a structure represented by formula (1) and a prepolymer derived from the compound including a structure represented by formula (1);

b) any one of or both a compound including a structure represented by formula (2) and a prepolymer derived from the compound including a structure represented by formula (2);

c) any one of or both a compound including a structure represented by formula (3) and a prepolymer derived from the compound including a structure represented by formula (3);

d) any one of or both a compound including a structure represented by formula (4) and a prepolymer derived from the compound including a structure represented by formula (4); and e) any one of or both a compound represented by formula (6) and a prepolymer derived from the compound represented by formula (6).

The ratio of the number of moles of isocyanate and the number of moles of a hydroxyl group in the mixture, namely, the isocyanate index (NCO/OH) is preferably 1.1 or more and 5.0 or less. The isocyanate index can fall within the range, resulting in suppression of remaining of an unreacted component in the binder resin, and excellent insulation properties in a high-temperature and high-humidity environment. In particular, the isocyanate index can be 5.0 or less, resulting in a reduction in hardness of the matrix in a low-temperature and low-humidity environment, and sufficient deformation due to pressing.

The structure of the binder resin can be confirmed by analysis with pyrolysis GC/MS (gas chromatograph mass spectrometer), FT-IR (Fourier transform infrared spectrophotometer), NMR (nuclear magnetic resonance apparatus) or the like.

(Conductive Particle)

The mode value of the sphere volume-equivalent diameter of the electro-conductive particle is preferably 3.0 μm or more and 20 μm or less. The average particle size can be 3.0 μm or more, thereby allowing insulation properties of the covering layer to be maintained in non-pressing. In addition, a local difference in thickness of the covering layer, in terms of an insulating layer, is easily generated. The mode value of the sphere volume-equivalent diameter can be 20 μm or less, thereby allowing a region conducted in pressing to be finer, easily resulting in suppression of the change in image density. The mode value of the sphere volume-equivalent diameter of the electro-conductive particle is further preferably 5.0 μm or more and 10 μm or less. The mode value of the sphere volume-equivalent diameter of the electro-conductive particle corresponds to the value measured according to a method described below.

The nano-indenter hardness on the electro-conductive particle on the outer surface of the covering layer is preferably 1.0 $N/mm^2$ or more and 10 $N/mm^2$ or less. The nano-indenter hardness on the electro-conductive particle is preferably higher than the nano-indenter hardness of the matrix. The nano-indenter hardness of a protrusion derived from the electro-conductive particle is preferably higher than the nano-indenter hardness of the matrix and is 1.0 $N/mm^2$ or more and 10 $N/mm^2$ or less because conductive properties of the covering layer are obtained in pressing, as described above. The nano-indenter hardness of a protrusion derived from the electro-conductive particle can be 10 $N/mm^2$ or less, thereby allowing the covering layer to be prevented from having a macroscopically extremely high hardness, resulting in a reduction in stress on toner.

The nano-indenter hardness on the electro-conductive particle is more preferably 2.0 $N/mm^2$ or more and 5.0 $N/mm^2$ or less. The nano-indenter hardness on the electro-conductive particle is preferably higher than the nano-indenter hardness of the matrix by 0.5 $N/mm^2$ or higher, more preferably by 1.0 $N/mm^2$ or higher. The nano-indenter hardness corresponds to the value measured according to a method described below. While the nano-indenter hardness on the electro-conductive particle is affected by the hardness of the matrix, such hardness can be less affected due to measurement according to a method described below and thus correlation thereof to the functionality of the present disclosure can be accurately estimated.

The proportion of the electro-conductive particle in the total volume of the covering layer can be 20% by volume or more and 45% by volume or less. The proportion is preferably 20% by volume or more because approaching of the electro-conductive particle can be made in pressing to such an extent that an electric passage is formed, resulting in suppression of the change in image density. The proportion is preferably 45% by volume or less because the covering layer can be inhibited from being conducted in non-pressing and also the electro-conductive particle is easily decreased in the arithmetic mean value of the number thereof stacked in the thickness direction of the covering layer and an excellent toner conveying force is easily achieved. The proportion is more preferably 30% by volume or more and 40% by volume or less. The proportion (% by volume) of the electro-conductive particle can be measured according to a method described below.

The volume resistivity of the electro-conductive particle is preferably $1.0\times10^2$ Ω·cm or less because a proper development electric field can be rapidly formed in pressing. The volume resistivity is more preferably $1.0\times10^1$ Ω·cm or less, further preferably $1.0\times10^0$ Ω·cm or less. The lower limit of the volume resistivity is not particularly limited, and can be, for example, $1.0\times10^{-8}$ Ω·cm or more. The volume resistivity can be here measured according to the above method.

The electro-conductive particle preferably has a spherical shape from the viewpoint that insulation properties are easily obtained in non-pressing. The "spherical shape" here means that the ratio of the longer diameter/the shorter diameter of the particle is 1.0 to 1.5. The ratio of the longer diameter/the shorter diameter is preferably 1.0 to 1.2, more preferably 1.0 to 1.1. The longer diameter and the shorter diameter of the electro-conductive particle dispersed in the matrix can be calculated by observation with an ion beam processing apparatus (FIB-SEM), as in measurement of the average particle size, described below.

Examples of the electro-conductive particle having such characteristics include the following conductive particles: a metal particle such as an Au powder and an iron powder, a resin particle having a surface coated with a metal such as Ag, a particle of an inorganic compound such as zinc oxide, having a surface coated with a metal, a particle of an inorganic compound doped with a metal, a resin particle having a surface to which an electro-conductive fine particle such as carbon black is attached, an inorganic compound particle having a surface to which an electro-conductive fine particle is attached, a resin particle encapsulating an electro-conductive fine particle, a resin particle encapsulating an ion-conductive agent such as a quaternary ammonium salt, a graphite particle, and a carbon particle. Such conductive particles can be, if necessary, used singly or in combinations of two or more thereof. In particular, a carbon particle is preferable because the particle is excellent in conductive properties and hardness. A carbon particle obtained by carbonization of a resin particle such as a phenol resin with a high-temperature treatment is more preferably used because an excellent toner conveying force is achieved. The carbon particle obtained by carbonization of a resin particle with a high-temperature treatment has a smooth surface, has a small specific surface area and has a surface hydrophobized with a high-temperature treatment. Thus, such a carbon particle is hardly aggregated and arranged in the matrix, and is easily dispersed in the state of being properly aligned.

Examples of a commercially available product of such a carbon particle include ICB 0520 (trade name, manufactured by Nippon Carbon Co Ltd.).

In particular, the binder resin preferably has any one of or both the structures represented by formulae (1) and (2), any one of or both the structures represented by formulae (3) and (4), and the structure represented by formula (5) and the electro-conductive particle is preferably such a carbon particle because an excellent toner conveying force can be obtained even in a high-temperature and high-humidity environment. The reason is considered because of not only characteristics of the binder resin having the above structures, but also suppression of waviness of the matrix in formation of the covering layer in the case of combination use of the binder resin and the carbon particle. Such suppression of waviness of the matrix in formation of the covering layer allows the difference in thickness of the covering layer, in terms of an insulating layer, to be easily generated. It is thus considered that a local potential difference on the outer surface of the covering layer is steeper and an excellent toner conveying force is obtained. While the reason why waviness of the matrix is suppressed by a combination of the binder resin and the electro-conductive particle is still being tried to be figured out, it is presumed by the present inventors as follows. That is, it is presumed that waviness on the outer surface of the covering layer is suppressed because the binder resin having any one of or both the structures represented by formulae (1) and (2), any one of or both the structures represented by formulae (3) and (4), and the structure represented by formula (5), and the carbon particle are close to each other in terms of the surface free energy to result in a reduction in an aggregation force of the carbon particle.

The specific perimeter of the carbon particle, obtained according to a measurement method described below, is further preferably 1.1 or less because a more excellent toner conveying force can be obtained in a high-temperature and high-humidity environment. The reason is considered because waviness of the matrix in formation of the covering layer is further suppressed by combination use of the binder resin and the carbon particle having the specific perimeter. While the reason why waviness of the matrix is suppressed by a combination of the binder resin and the electro-conductive particle is still being tried to be figured out, it is presumed by the present inventors as follows. That is, it is presumed that waviness on the outer surface of the covering layer is further suppressed by a reduction in interaction between the binder resin and the carbon particle due to a very smooth surface of the electro-conductive particle where the specific perimeter is 1.05 or less.

(Insulating Particle)

The covering layer in the present aspect may further include an insulating particle, in addition to the electro-conductive particle.

The average particle size of the insulating particle is preferably 3.0 μm or more and 30 μm or less. The average particle size can be 3.0 μm or more, thereby resulting in an increase in thickness of an insulating layer at any position where the insulating particle is present and an increase in potential difference from the potential in a surrounding region where the electro-conductive particle is present, to allow a more excellent toner conveying force to be exerted. The average particle size can be 30 μm or less, thereby allowing conducting of the covering layer in pressing to be sufficiently maintained, resulting in easy suppression of the change in image density. The average particle size is more preferably 5.0 μm or more and 15 μm or less. The average particle size can be measured according to a method described below.

The volume resistivity of the insulating particle is preferably $1.0\times10^{10}$ Ω·cm or more because an increase in potential difference from the potential in a surrounding region where the electro-conductive particle is present allows a more excellent toner conveying force to be easily exerted. The volume resistivity is more preferably $1.0\times10^{13}$ Ω·cm or more. The upper limit of the volume resistivity is not particularly limited, and is preferably, for example, $1.0\times10^{16}$ Ω·cm or less because the change in image density is easily suppressed. The volume resistivity can be here measured according to the above method.

Examples of the insulating particle having such characteristics include particles of resins such as an acrylic resin, a urethane resin, a fluororesin, a polyester resin, a polyether resin and a polycarbonate resin, and particles of inorganic compounds such as silica, alumina and silicon carbide. Such particles may be used singly or in combinations of two or more thereof. In particular, a resin particle is preferable from the viewpoint that flexibility is simultaneously obtained which corresponds to general mechanical characteristics required for the developing roller.

The proportion of the insulating particle in the total volume of the matrix is preferably 1% by volume or more and 20% by volume or less. The proportion can be 1% by volume or more, thereby allowing a more excellent toner conveying force to be exerted. The proportion is 20% by volume or less, thereby allowing conducting of the covering layer in pressing to be easily maintained. The proportion is more preferably 3% by volume or more and 10% by volume or less. The proportion corresponds to the value measured according to a method described below.

(Additive(s))

The covering layer in the present aspect can include various additives other than the binder resin, the electro-conductive particle and the insulating particle, as long as features of the present disclosure are not impaired. For example, a fine particle of an inorganic compound such as silica can be compounded into the covering layer, thereby imparting reinforcing properties to the covering layer and adjusting the permittivity of the matrix. Such a fine particle of an inorganic compound, as an additive, herein refers to one having an average particle size of less than 1.0 μm. An organic compound-based additive such as silicone oil may be compounded into the covering layer for the purpose of enhancements in performances required for the developing roller, such as an enhancement in toner releasability and a reduction in coefficient of dynamic friction.

(Method for Forming Covering Layer)

The method for forming the covering layer is not particularly limited, and the covering layer can be formed by the following method. A coating liquid for covering layer formation, including the binder resin, the electro-conductive particle, and, if necessary, the insulating particle and the additive, is prepared. A substrate or a substrate where an electro-conductive elastic layer or the like is formed is dipped in the coating liquid, and dried, thereby forming the covering layer on the substrate.

<Conductive Elastic Layer>

In the present disclosure, an electro-conductive elastic layer may be, if necessary, provided between the substrate and the covering layer in order to impart elasticity required for an image forming apparatus to be used, to the developing roller. The electro-conductive elastic layer may be any of a solid member or a foam member. The electro-conductive elastic layer may be made of a single layer or a plurality of layers. For example, the developing roller is constantly in pressure-contact with a photosensitive member and toner, and thus an electro-conductive elastic layer having characteristics of a low hardness and a low compression permanent distortion can be provided for the purpose of a reduction in damage mutually caused between such members. Examples of the material of the electro-conductive elastic layer can include natural rubber, isoprene rubber, styrene rubber, butyl rubber, butadiene rubber, fluororubber, urethane rubber and silicone rubber. Such materials can be used singly or in combinations of two or more thereof.

The electro-conductive elastic layer may contain an electro-conductive agent, a non-conductive filler, and any other various additive components required for molding, such as a crosslinking agent, a catalyst and a dispersion promoter, depending on any function required for the developing roller. Any of various conductive metals or alloys thereof, conductive metal oxides, fine powders of insulating substances, covered therewith, electroconductive agents, ion-conductive agents, and the like can be used for the electro-conductive agent. Such conductive agents can be used in the form of a powder or fiber, singly or in combinations of two or more thereof. In particular, carbon black as an electro-conductive agent is preferable because of easiness of control of conductive properties and economic efficiency. Examples of the non-conductive filler can include the following: diatomaceous earth, a quartz powder, dry silica, wet silica, titanium oxide, zinc oxide, aluminosilicic acid, calcium carbonate, zirconium silicate, aluminum silicate, talc, alumina and iron oxide. Such fillers may be used singly or in combinations of two or more thereof.

The volume resistivity of the electro-conductive elastic layer is preferably $1.0\times10^4$ to $1.0\times10^{10}$ Ω·cm. The volume resistivity of the electro-conductive elastic layer falls within the range, resulting in easy suppression of the variation in development electric field. The volume resistivity is more preferably $1.0\times10^4$ to $1.0\times10^9$ Ω·cm. The volume resistivity of the electro-conductive elastic layer can be controlled by the content of the electro-conductive agent in the electro-conductive elastic layer.

The asker C hardness of the electro-conductive elastic layer is preferably 10 degrees or more and 80 degrees or less. The asker C hardness can be 10 degrees or more, resulting in suppression of compression permanent distortion due to each member disposed opposite to the developing roller. The asker C hardness can be 80 degrees or less, resulting in suppression of stress on toner, and suppression of a reduction in image quality due to repeated image formation. The asker C hardness here corresponds to the value measured with an Asker rubber hardness meter (manufactured by Kobunshi Keiki Co., Ltd.). The thickness of the electro-conductive elastic layer is preferably 0.1 mm or more and 50.0 mm or less, more preferably 0.5 mm or more and 10.0 mm or less.

Examples of the method for forming the electro-conductive elastic layer can include a method for forming the electro-conductive elastic layer on the substrate by heating and curing at a proper temperature for a proper time by various molding methods such as extrusion molding, press molding, injection molding, liquid injection molding and cast molding. For example, the electro-conductive elastic layer can be accurately formed on the outer periphery of the substrate by injecting an uncured conductive elastic layer material to a cylindrical mold on which the substrate is disposed, and heating and curing the material.

[Process Cartridge and Image Forming Apparatus]

The process cartridge according to the present aspect is a process cartridge to be detachably mounted to an image forming apparatus, the process cartridge including the developing roller according to the present aspect. The image forming apparatus according to the present aspect includes a photosensitive member and the developing roller according to the present aspect, the developing roller being disposed with abutting with the photosensitive member. According to the present disclosure, a process cartridge and an image forming apparatus that can stably provide a high-quality image in various environments can be provided.

Figure 3:
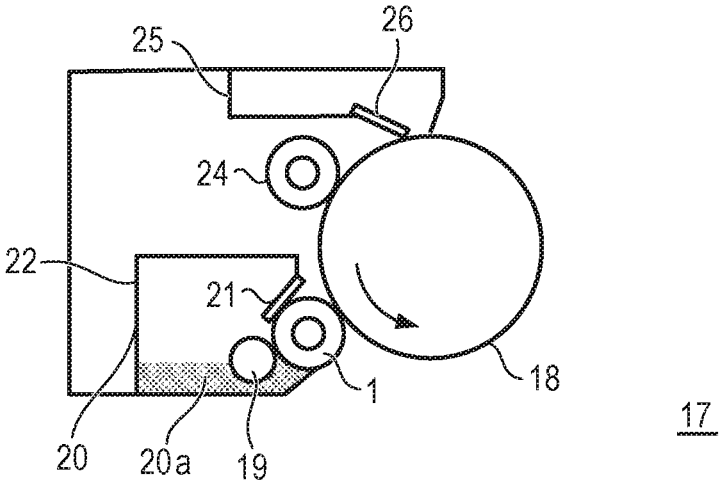
FIG. 3 is a schematic configuration view illustrating one embodiment of a process cartridge according to the present aspect.

FIG. 3 illustrates one embodiment of the process cartridge according to the present aspect. A process cartridge 17 illustrated in FIG. 3 is configured to be detachable to the main body of an electrophotographic apparatus, and includes a developing roller 1 according to the present aspect, a developing blade 21, a toner container 20 that receives toner 20*a* and a developing apparatus 22 including a toner feed roller 19. The process cartridge 17 illustrated in FIG. 3 is an all-in-one process cartridge that integrally supports a photosensitive member 18, a cleaning blade 26, a waste toner receiving container 25 and a charging roller 24.

Figure 4:
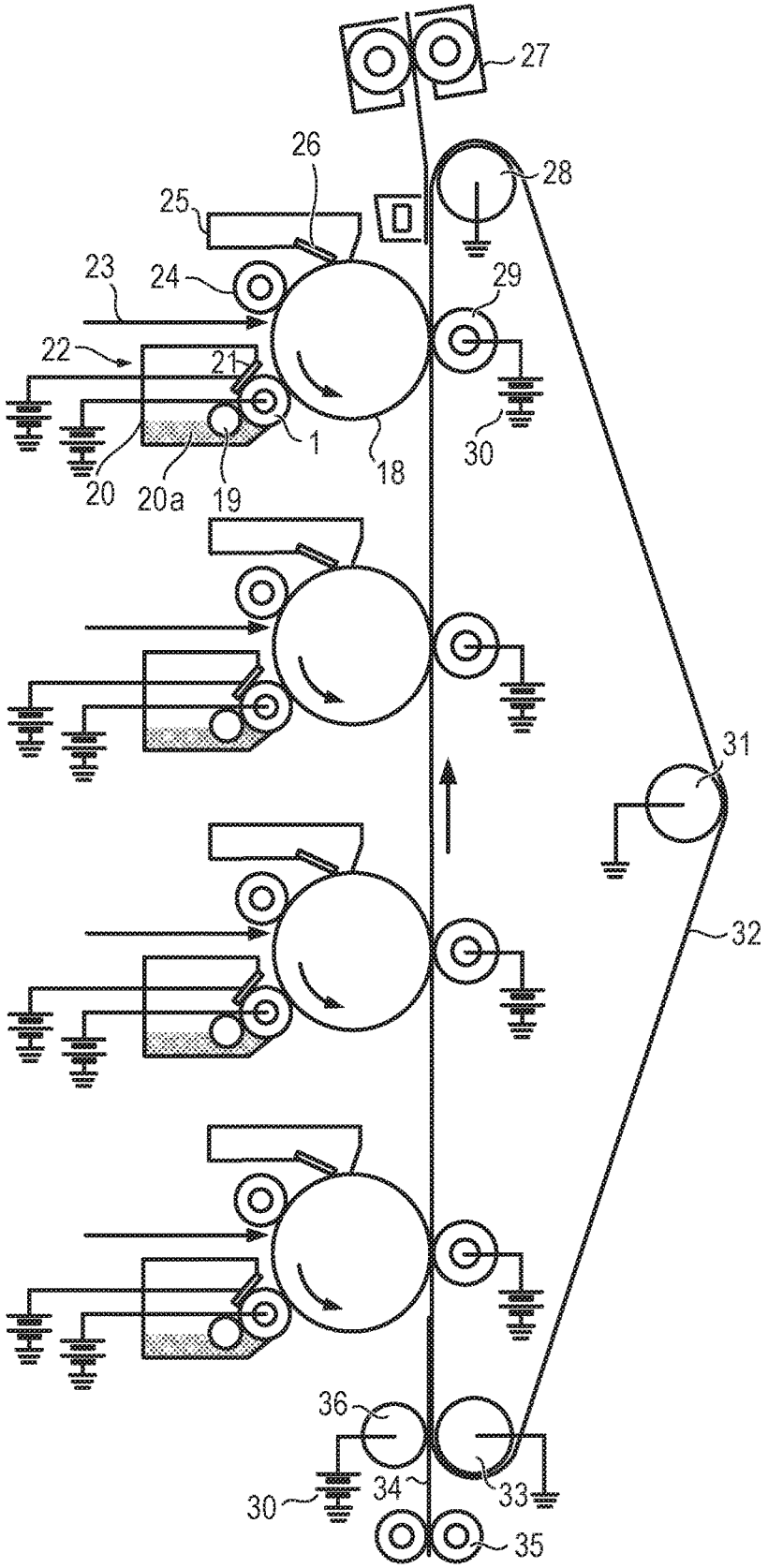
FIG. 4 is a schematic configuration view illustrating one embodiment of an image forming apparatus according to the present aspect.

FIG. 4 illustrates one embodiment of the image forming apparatus according to the present aspect. A developing apparatus 22 including a developing roller 1, a toner feed roller 19, a toner container 20 and a developing blade 21 is detachably mounted to an image forming apparatus illustrated in FIG. 4. A process cartridge is also detachably mounted thereto, which includes the developing apparatus 22, a photosensitive member 18, a cleaning blade 26, a waste toner receiving container 25 and a charging roller 24. The photosensitive member 18, the cleaning blade 26, the waste toner receiving container 25 and the charging roller 24 may also be herein provided on the main body of the image forming apparatus.

The photosensitive member 18 is rotated in an arrow direction and thus evenly charged by the charging roller 24 that performs a charging treatment of the photosensitive member 18, thereby resulting in formation of an electrostatic latent image on the surface of the photosensitive member by laser light 23 that is an exposure unit for writing an electrostatic latent image onto the photosensitive member 18. The electrostatic latent image is developed by application of toner 20*a* with the developing apparatus 22 that is disposed in contact with the photosensitive member 18, and thus is visualized as a toner image. The development is so-called reversal development that forms a toner image on an exposed region. The toner image visualized on the photosensitive member 18 is transferred to paper 34 as a recording medium, by a transfer roller 29 as a transfer member. The paper 34 is fed into the apparatus through a paper-feeding roller 35 and an adsorption roller 36, and conveyed between the photosensitive member 18 and the transfer roller 29 by an endless belt-shaped transfer conveyance belt 32. The transfer conveyance belt 32 is driven by a driven roller 33, a driving roller 28 and a tension roller 31. A voltage is applied to the transfer roller 29 and the adsorption roller 36 from a bias power source 30. The paper 34 onto which the toner image is transferred is subjected to a fixing treatment by a fixing apparatus 27 and discharged out of the apparatus, and a printing operation is thus terminated. On the other hand, transfer residual toner that is not transferred and remains on the photosensitive member 18 is scraped by a cleaning blade 26 as a cleaning member for cleaning the surface of the photosensitive member 18, and is received in the waste toner receiving container 25. The cleaning photosensitive member 18 cleaned performs the above operation repeatedly.

The developing apparatus 22 includes the toner container 20 that receives toner 20*a* as one-component toner, and a developing roller 1 as a toner carrier located in an opening extending in the longitudinal direction of the toner container 20 and disposed opposite to the photosensitive member 18. The developing apparatus 22 allows an electrostatic latent image on the photosensitive member 18 to be developed and visualized. A member for use in the developing blade 21 is, for example, a member obtained by securing a rubber elastic body to a metallic plate, a member having spring properties as in a thin plate of SUS or phosphor bronze, or a member having a surface on which a resin or rubber is laminated. Any potential difference can be provided between the developing blade 21 and the developing roller 1, thereby allowing a toner layer on the developing roller 1 to be controlled, and thus the developing blade 21 preferably has conductive properties. Each voltage is here applied to the developing roller 1 and the developing blade 21 from the bias power source 30, and the difference between the voltage to be applied to the developing blade 21 and the voltage to be applied to the developing roller 1 is preferably about 0 V to −300 V.

A developing process in the developing apparatus 22 is described below. The developing roller 1 is coated with the toner 20*a* by the toner feed roller 19 rotatably supported. The toner 20*a* with which the developing roller 1 is coated is rubbed with the developing blade 21 due to rotation of the developing roller 1. A bias here applied to the developing blade 21 allows the developing roller 1 to be coated with the toner 20*a* located on the developing roller 1. The developing roller 1 is brought into contact with the photosensitive member 18 with being rotated, and an electrostatic latent image formed on the photosensitive member 18 is developed by the toner 20*a* with which the developing roller 1 is coated, resulting in image formation. The structure of the toner feed roller 19 is preferably a foam skeleton-like sponge structure or a fur brush structure where a fiber such as rayon or polyamide is grafted onto a substrate, in terms of feeding of the toner 20*a* to the developing roller 1 and stripping of undeveloped toner. For example, an elastic roller where polyurethane foam is provided around a substrate can be used as the toner feed roller 19.

EXAMPLES

Example 1

<1. Production of Conductive Elastic Roller>

An axial core made of stainless steel (SUS 304) having an outer diameter of 6 mm and a length of 270 mm was coated with a primer (trade name: DY35-051, manufactured by Dow Corning Toray Co., Ltd.), and baked to prepare a substrate. The substrate was placed in a mold, and an addition-type silicone rubber composition where materials represented in Table 1 below were mixed was injected into a cavity formed in the mold. Subsequently, the mold was heated to thereby allow the addition-type silicone rubber composition to be heated and cured at a temperature of 150° C. for 15 minutes, and was released. Thereafter, a curing reaction was terminated by further heating at a temperature of 180° C. for 1 hour, thereby producing conductive elastic roller 1 including an electro-conductive elastic layer having a thickness of 2.75 mm on the outer periphery of the substrate.

TABLE 1

| Material | parts by mass |
|---|---|
| Liquid silicone rubber material (trade name: SE6724A/B, manufactured by Dow Corning Toray Co., Ltd.) | 100 |
| Carbon black (trade name: Tokablack #7360SB: manufactured by Tokai Carbon Co., Ltd.) | 20 |
| Platinum catalyst | 0.1 |

<2. Preparation of Coating Liquid G-1>

Under a nitrogen atmosphere, 100 parts by mass of a polybutadiene polyol (trade name: G2000, manufactured by Nippon Soda Co., Ltd.) was gradually dropped to 27 parts by mass of polymeric MDI (trade name: Millionate MR 200, manufactured by Nippon Polyurethane Industry Co., Ltd.) in a reaction vessel. The temperature in the reaction vessel was here kept at 65° C. After completion of the dropping, a reaction was allowed to run at 65° C. for 2 hours. The resulting reaction mixture was cooled to room temperature, thereby providing isocyanate group-terminated prepolymer B-1 having an isocyanate group content of 4.3% by mass.

55.0 parts by mass of the isocyanate group-terminated prepolymer B-1, 45.0 parts by mass of hydrogenerated polyisoprene polyol A-1 (trade name: Epol, manufactured by Idemitsu Kosan Co., Ltd.), 90.0 parts by mass of carbon particle C-1 (trade name: ICB 0520, manufactured by Nippon Carbon Co., Ltd.) and 5.0 parts by mass of acrylic particle D-1 (trade name: Techpolymer MBX-15, manufactured by Sekisui Plastics Co., Ltd.) were added to methyl ethyl ketone (MEK). The solid content was adjusted so as to be 40% by mass, thereby providing mixed liquid 1. A glass bottle having an interior volume of 450 mL was charged with 250 parts by mass of mixed liquid 1 and 200 parts by mass of glass beads having an average particle size of 0.8 mm, and the resultant was dispersed with a paint shaker (manufactured by Toyo Seiki Seisaku-sho, Ltd.) for 30 minutes. Thereafter, the glass beads were removed, thereby providing coating liquid G-1 for covering layer formation.

<3. Production of Developing Roller>

The electro-conductive elastic roller 1 was dipped in the coating liquid G-1 once, and then air-dried at 23° C. for 30 minutes. Next, the resultant was dried in a hot air circulation dryer set to 160° C., for 1 hour, thereby producing developing roller X-1 where a covering layer was formed on the outer periphery of conductive elastic roller 1. The dip coating time was herein 9 seconds. The dip coating lifting speed was adjusted so that the initial speed was 20 mm/sec and the final speed was 2 mm/sec, and the speed was changed linearly to the time in the speed range from 20 mm/sec to 2 mm/sec.

<4. Evaluations of Physical Properties>

(Evaluation 4-1. Current Value in Non-Pressing)

The current value in a measurement range of 90 μm×90 μm on the outer surface of the covering layer in the present disclosure is here measured by scanning in a tapping mode with application of a potential difference of 10 V in the thickness direction of the covering layer with a scanning probe microscope and a cantilever having a triangular pyramid-shaped tip, a radius of curvature of the tip of 25 nm and a constant of spring of 42 N/m in an environment of a temperature of 23° C. and a relative humidity of 50%, and is designated as "current value in non-pressing". The current value on the covering layer in non-pressing was measured with a scanning probe microscope (trade name: MFP-3D-

Origin, manufactured by Oxford Instruments). The measurement conditions are represented below.

Cantilever: ASYELEC-02, manufactured by Olympus Corporation (tip shape: triangular pyramid, radius of curvature of tip: 25 nm, constant of spring: 42 N/m)

Mode: tapping mode

Measurement region: 90 μm×90 μm

Number of measurement points: 256 points×256 points

Scanning speed: 0.3 Hz

Voltage applied: 10 V

Measurement environment: temperature: 23° C.; relative humidity: 50%

The measurement was performed at 9 positions in total of 3 positions in the axial direction×3 positions in the circumferential direction of the covering layer. The arithmetic mean value and the standard deviation were determined from the resulting measurement values. The results are represented as "arithmetic mean value" and "standard deviation" of the current value in non-pressing, in Table 5.

(Evaluation 4-2. Conductive Point Density in Pressing)

The electro-conductive point density on the outer surface of the covering layer in pressing was measured with a scanning probe microscope. Specifically, MFP-3D-Origin manufactured by Oxford Instruments was used. The measurement conditions are represented below.

Cantilever: ASYELEC-02, manufactured by Olympus Corporation (tip shape: triangular pyramid, radius of curvature of tip: 25 nm, constant of spring: 42 N/m)

Mode: contact mode

Contact pressure: 2.0 μN (impulse: 77 nm/V)

Measurement region: 90 μm×90 μm

Number of measurement points: 256 points×256 points

Scanning speed: 0.3 Hz

Voltage applied: 10 V

Measurement environment: temperature: 23° C.; relative humidity: 50%

A current image of the measurement range was obtained by the measurement. The developing roller according to the present aspect allows a high current value to be obtained due to exhibiting of conductive properties at a position of the electro-conductive particle in such measurement. Thus, the current image is obtained as an image including an island-like independent region at a position of the electro-conductive particle. A region where the current value was 1 μA or more in the measurement was here defined as a region where conductive properties were exhibited, and the number of such independent regions where conductive properties were exhibited, in the measurement range, was counted. The electro-conductive point density in pressing was calculated from the number of such independent regions and the area of the measurement range, as the number of independent regions/the area of the measurement range. The measurement was performed at 9 positions in total of 3 positions in the axial direction×3 positions in the circumferential direction of the covering layer. The arithmetic mean value of the electro-conductive point density in pressing was determined from the resulting measurement values. The results are represented as "conductive point density in pressing" in Table 5.

(Evaluation 4-3. Local Potential Difference)

The outer surface of the covering layer was charged with a corona discharge apparatus (trade name: DRA-2000L, manufactured by Quality Engineering Associates (QEA) Inc.) in an environment of a temperature of 23° C. and a relative humidity of 50%. The apparatus was equipped with a head where a corona discharger and a probe of a surface potential meter were integrated, and the head could be moved with corona discharge being performed.

Specifically, charging was made with scanning at a rate of 400 mm/sec in the longitudinal direction of the developing roller with a potential difference of +8 kV being provided relative to the outer surface of the covering layer and a distance between the outer surface of the covering layer and the corona charger being 1 mm.

Next, the potential was measured since 1 minute after the charging, by use of a high spatial resolution surface potential measurement apparatus with scanning of a range of 99 μm×99 μm on the outer surface of the covering layer at a distance between the outer surface of the covering layer and the cantilever of the high spatial resolution surface potential measurement apparatus of 5 μm, in an environment of a temperature of 23° C. and a relative humidity of 50%. The standard deviation of the resulting potential was here designated as "local potential difference".

The local potential difference of the covering layer was determined by measuring the potential of the surface of the developing roller charged by corona discharge, with an electrostatic force microscope. The measurement environment was at a temperature of 23° C. and a relative humidity of 50%.

A specific operation method herein was as follows. First, a master made of stainless steel (SUS 304), having the same diameter as the diameter of the developing roller, was placed in a corona discharge apparatus, and the master was short-circuited to the ground. Next, the distance between the surface of the master and the probe of the surface potential meter was adjusted to 1.0 mm, and calibration was made so that zero was indicated by the surface potential meter. After the calibration, the master was removed and the developing roller to be charged was placed in the apparatus. The developing roller was charged with the bias of the corona discharger being set to +8 kV, an electro-conductive substrate of the developing roller being GND and the speed of movement of the scanner being 400 mm/sec.

Subsequently, the potential of the developing roller charged was measured with a high spatial resolution surface potential measurement apparatus (MODEL 1100 TN, manufactured by Trek Japan). A commercially available high-accuracy XY stage was used for scanning of the developing roller. The measurement conditions are represented below.

Measurement environment: temperature: 23° C.; relative humidity: 50%;

Time from corona discharge until start of measurement: 1 minute;

Cantilever: trade name: Model 1100TNC-NPR, manufactured by Trek Japan;

Gap between surface of covering layer and tip of cantilever: 5 μm;

Measurement region: 99 μm×99 μm;

Measurement interval: 3 μm×3 μm.

The measurement was performed at 9 positions in total of 3 positions in the axial direction×3 positions in the circumferential direction of the covering layer. The arithmetic mean value and the standard deviation of the surface potential were determined from the resulting measurement values. The results are represented as "arithmetic mean value" and "standard deviation" of the surface potential in Table 5.

(Evaluation 4-4. Roller Volume Resistivity in Pressing)

Figure 5:
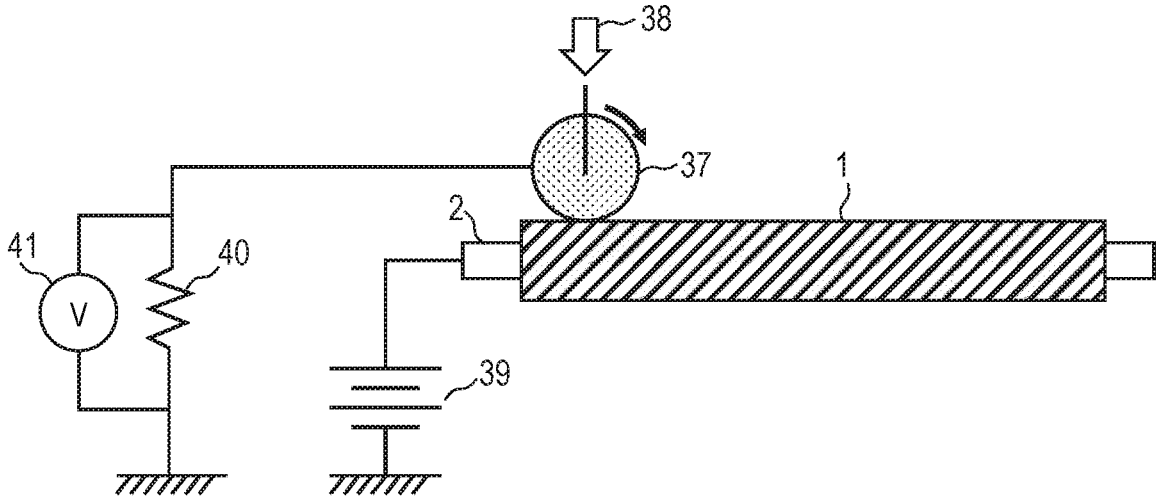
FIG. 5 is a schematic configuration view of an apparatus for use in measurement of a current value in pressing in Examples.

The volume resistivity of the developing roller in pressing was measured with an apparatus illustrated in FIG. 5. The measurement was performed in an environment of a temperature of 23° C. and a relative humidity of 50%.

A stainless steel roller 37 having a diameter of 30 mm and a width of 10 mm was located where the surface in the circumferential direction of the stainless steel roller 37 was allowed to be opposite to the surface in the circumferential direction of a developing roller 1 so that the axial direction of the stainless steel roller 37 was perpendicular to the axial direction of the developing roller 1.

Next, the stainless steel roller 37 was allowed to abut at a load 38 so that the pressure applied to the surface of the developing roller 1 was 50 kPa.

Next, a potential difference of 10 V was applied between the resultant and an electro-conductive substrate 2 from a high-pressure power source 39.

Next, the stainless steel roller 37 was rolled by a driving unit not illustrated, at a rate of 50 mm/sec in the axial direction of the developing roller in a range where both end portions in the axial direction of the developing roller were removed by 5 mm.

The potential difference between the stainless steel roller 37 and the electro-conductive substrate 2 was here measured at an interval of 1000 Hz by a recorder 41. The current value was then determined from the potential difference, measured, and the electric resistivity of a resistor 40.

The measurement was performed at 36 positions in the circumferential direction of the developing roller.

The volume resistivity was calculated from the current value measured, the abutment area where the pressure applied to the surface of the developing roller 1 from the stainless steel roller 37 was 0.10 MPa, and the thickness of the developing roller, separately measured, and the arithmetic mean value and the standard deviation were calculated.

The calculation results are represented as "arithmetic mean value" and "standard deviation" of the volume resistivity of the roller in pressing, in Table 5.

The load where the pressure applied to the surface of the developing roller was 0.10 MPa, and the abutment area here were determined as follows. A prescale (manufactured by Fujifilm Corporation; tasimetric (4 LW)) was sandwiched between the stainless steel roller 37 and the developing roller 1, and a weight was loaded on the stainless steel roller 37 to apply a load 38 to the developing roller 1. Next, the abutment area was determined based on a region of the prescale, colored in red, with an optical microscope. The load and the abutment area here were used to calculate the pressure applied to the surface of the developing roller 1 from the stainless steel roller 37, as "load/abutment area". Such an operation was performed with the weight being changed, thereby determining a load where the pressure applied to the surface of the developing roller 1 from the stainless steel roller 37 was 0.10 MPa.

(Evaluation 4-5. Thickness of Covering Layer)

Each cross section at 9 positions in total of 3 positions in the axial direction×3 positions in the circumferential direction of the covering layer was observed with an optical microscope or an electron microscope. The thickness of the covering layer was measured randomly at 10 points with respect to each of such measurement positions. The arithmetic mean value of the respective thicknesses at 90 points in total was defined as the thickness of the covering layer. The results are represented as "thickness" in Table 6.

(Evaluation 4-6. Nano-Indenter Hardness)

The nano-indenter hardness of the matrix and the nano-indenter hardness on the electro-conductive particle were measured with an ultramicro hardness meter (trade name: PICOPDENTOR HM-500, manufactured by Helmut Fischer GmbH). The measurement conditions are represented below.

Measurement indenter: Vickers indenter, face angle: 136, Young's modulus: 1140, Poisson's ratio: 0.07;

Indenter material: diamond;

Measurement environment: temperature: 23° C.; relative humidity: 50%;

Load speed: 0.10 mN/10 seconds.

In the present evaluation, the Martens hardness calculated from the following calculation expression (1) was defined as "nano-indenter hardness". Herein, measurement on the matrix corresponded to measurement between such conductive particles, and measurement on the electro-conductive particle corresponded to measurement on the top of any protrusion derived from the electro-conductive particle. The hardness of the matrix and the hardness on the electro-conductive particle were each measured at 9 positions in total of 3 positions in the axial direction×3 positions in the circumferential direction of the covering layer, and the average value was determined. The Martens hardness was calculated according to the following calculation expression (1) by allowing the tip of the indenter to abut and applying a load F at a rate described in the conditions to determine the indentation depth h where the load F reached 0.10 mN. Table 6 shows the nano-indenter hardness of the matrix as "Hardness" of the matrix, and the nano-indenter hardness on the electro-conductive particle as "Hardness" of the electro-conductive particle.

$$\text{Nano-indenter hardness (N/mm}^2\text{)} = F\text{ (N)/surface area (mm}^2\text{) of indenter at test load} = F/(26.43 \times h^2) \qquad \text{Calculation expression (1)}$$

F: load (N)

h: indentation depth (mm) of indenter (Evaluation 4-7. Mode Value of Sphere Volume-Equivalent Diameter of Conductive Particle)

The respective mode values of the sphere volume-equivalent diameters of the electro-conductive particle and the insulating particle were measured with FIB-SEM (trade name: NVision 40, manufactured by Carl Zeiss Microscopy GmbH).

A specific measurement procedure is described below. A cutter blade was applied to the developing roller, and each section was cut out at a length of 5 mm in the x-axial direction (the longitudinal direction of the roller) and in the y-axial direction (the tangential direction of a circular cross section in a transverse section of the roller, the section being perpendicular to the x-axis).

The section cut out was observed with an FIB-SEM apparatus at an acceleration voltage of 10 kV and at a magnification of 1000-fold in the z-direction (the diametrical direction in a transverse section of the roller, the section being perpendicular to the x-axis).

Next, slicing was made at an interval of 100 nm in the z-direction, and a cross-sectional image was taken from the surface in the entire z-direction of the covering layer. The resulting cross-sectional image was binarized with analysis software according to the Otsu's method, and thus three-dimensionally constructed, and the volume of the electro-conductive particle was calculated.

The sphere volume-equivalent diameter $((3\times\text{volume of conductive particle}/4\times\pi)^{1/3})$ was calculated from the resulting volume of the electro-conductive particle. Such an operation was performed at 9 positions or more in total of 3 positions in the axial direction×3 positions in the circumferential direction of the developing roller, thereby providing the volumes and the sphere volume-equivalent diameters of 500 of the electro-conductive particles.

The results obtained were used to create a histogram having a horizontal axis with respect to the sphere volume-equivalent diameter, with an interval of 0.1 μm, and a vertical axis with respect to the proportion of the electro-conductive particle included at an interval of each sphere volume-equivalent diameter, in the total conductive particle volume, and a sphere volume-equivalent diameter having the highest volume proportion was defined as the mode value of the sphere volume-equivalent diameter of the electro-conductive particle.

In the case where the sphere volume-equivalent diameter having the highest volume proportion was 7.1 μm or more and less than 7.2 μm, the mode value was here defined as 7.1 μm. The results are represented as "particle size" in Table 6.

(Evaluation 4-8. Contents of Conductive Particle and Insulating Particle)

The contents of the electro-conductive particle and the insulating particle (% by volume) were measured with FIB-SEM (trade name: NVision40, manufactured by Carl Zeiss Microscopy GmbH).

A specific measurement procedure is described below. A cutter blade was applied to the developing roller, and each section was cut out at a length of 5 mm in the x-axial direction (the longitudinal direction of the roller) and in the y-axial direction (the tangential direction of a circular cross section in a transverse section of the roller, the section being perpendicular to the x-axis).

The section cut out was observed with an FIB-SEM apparatus at an acceleration voltage of 10 kV and at a magnification of 1000-fold in the x-direction. Next, slicing was made at an interval of 100 nm in the z-direction, and 300 cross-sectional images in total were taken from the surface to a depth of 30 μm.

The resulting cross-sectional image was binarized with analysis software according to the Otsu's method, and thus three-dimensionally constructed, and the respective volumes of the covering layer, the electro-conductive particle and the insulating particle were calculated. Such an operation was performed at 9 positions in total of 3 positions in the axial direction×3 positions in the circumferential direction of the developing roller.

The arithmetic mean value of the volume of the electro-conductive particle relative to the volume of the covering layer, and the arithmetic mean value of the volume of the insulating particle relative to the volume of the covering layer, at each position, were defined as the proportion (% by volume) of the electro-conductive particle in the total volume of the covering layer, and the proportion (% by volume) of the insulating particle in the total volume of the covering layer, respectively. The results are represented as "content" in Table 6.

(Evaluation 4-9. Stacking of Conductive Particle)

Stacking of the electro-conductive particle in the thickness direction of the covering layer was determined with FIB-SEM (trade name: NVision 40, manufactured by Carl Zeiss Microscopy GmbH).

A specific measurement procedure is described below. A cutter blade was applied to the developing roller, and each section was cut out at a length of 5 mm in the x-axial direction (the longitudinal direction of the roller) and in the y-axial direction (the tangential direction of a circular cross section in a transverse section of the roller, the section being perpendicular to the x-axis).

The section cut out was observed with an FIB-SEM apparatus at an acceleration voltage of 10 kV and at a magnification of 1000-fold in the x-direction. Next, slicing was made at an interval of 100 nm in the z-direction, and a cross-sectional image was taken from the surface in the entire z-direction of the covering layer. The resulting cross-sectional image was binarized with analysis software according to the Otsu's method, and thus three-dimensionally constructed.

The number of conductive particles stacked in the z-direction was counted at an interval of 1 μm×1 μm on the xy-plane in the resulting three-dimensional image, and the arithmetic mean value thereof was determined. The results are represented as "stacking" in Table 6.

(Evaluation 4-10. Potential Decay Time Constant of Matrix)

The potential decay time constant of the matrix was calculated from a decay transition obtained by measuring the decay transition of the potential of the surface of the matrix after charging by corona discharge, with an electrostatic force microscope. The potential of the matrix was defined as the surface potential at any position between the electro-conductive particles on the developing roller. The measurement was performed at a temperature of 23° C. and a relative humidity of 50%.

A corona discharge apparatus (trade name: DRA-2000L, manufactured by Quality Engineering Associates (QEA) Inc.) was used for the measurement. The apparatus was equipped with a head where a corona discharger and a probe of a surface potential meter were integrated, and the head could be moved with corona discharge being performed.

A master made of stainless steel (SUS 304), having the same diameter as the diameter of the developing roller, was placed in the apparatus, and the master was short-circuited to the ground. Next, the distance between the surface of the master and the probe of the surface potential meter was adjusted to 1.0 mm, and calibration was made so that zero was indicated by the surface potential meter.

After the calibration, the master was removed and the developing roller to be charged was placed in DRA-2000L. The developing roller was charged with the bias of the corona discharger being set to +8 kV, an electro-conductive substrate of the developing roller being GND and the speed of movement of the scanner being 400 mm/sec.

Subsequently, the potential of the surface of the matrix was measured with an electrostatic force microscope (trade name: MODEL 1100TN, manufactured by Trek Japan). A commercially available high-accuracy XY stage was used for scanning of the developing roller. The measurement conditions are represented below.

Measurement environment: temperature: 23° C.; relative humidity: 50%;

Time from corona discharge until start of measurement: 1 minute;

Cantilever: cantilever for EFM, equipped with light shielding plate;

Gap between surface of covering layer and tip of cantilever: 5 μm;

Measurement time: 100 sec;

Measurement interval: 100 Hz.

The resulting decay transition of the surface potential was used for fitting according to the following calculation expression (2) by a least-square method, and the time constant was thus calculated.

$$V=V0\times\exp((-t/\tau)^{1/2} \qquad \text{Calculation expression (2)}$$

V: measurement potential, V0: initial potential, t: lapse time from corona discharge until measurement, τ: time constant.

The measurement was performed at 9 positions in total of 3 positions in the axial direction×3 positions in the circumferential direction of the developing roller.

The arithmetic mean value was calculated from the resulting time constant, and defined as the potential decay time constant of the developing roller. The results are represented as "potential decay time constant" in Table 6.

(Evaluation 4-11. Roughness)

An objective lens having an enlargement factor of 50 was installed to a laser microscope (trade name: VK-8700, manufactured by Keyence Corporation) to observe the surface of the developing roller. Next, the resulting observation image was subjected to inclination correction. The inclination correction was performed in a quadratic surface correction (automatic) mode. Thereafter, the surface roughness was measured. The surface roughness was determined in the entire region subjected to the measurement, according to JIS B0601:2001. The measurement was performed at 9 positions in total of 3 positions in the axial direction×3 positions in the circumferential direction of the developing roller, and the average value was defined as the roughness of the surface of the developing roller. The results are represented as "roughness" in Table 6.

(Evaluation 4-12. Specific Perimeter of Conductive Particle)

The specific perimeter of the electro-conductive particle was measured with FIB-SEM (trade name: NVision40, manufactured by Carl Zeiss Microscopy GmbH).

A specific measurement procedure is described below. A cutter blade was applied to the developing roller, and each section was cut out at a length of 5 mm in the x-axial direction (the longitudinal direction of the roller) and in the y-axial direction (the tangential direction of a circular cross section in a transverse section of the roller, the section being perpendicular to the x-axis). The section cut out was observed with an FIB-SEM apparatus at an acceleration voltage of 10 kV and at a magnification of 1000-fold in the z-direction (the diametrical direction in a transverse section of the roller, the section being perpendicular to the x-axis). Next, slicing was made at an interval of 100 nm in the z-direction, and a cross-sectional image was taken from the surface in the entire z-direction of the covering layer. The cross-sectional image at the center position in the z-direction of the covering layer, as the cross-sectional image obtained, was binarized with analysis software according to the Otsu's method. The cross-sectional image binarized was used to measure the cross-sectional area and the perimeter of each conductive particle, with an automatic image analysis apparatus (Luzex manufactured by Nireco). The resulting cross-sectional area of each conductive particle was used to calculate the perimeter of the circle-area equivalent of each conductive particle ($2\times\pi\times(4\times$cross-sectional area of conductive particle$/\pi)^{1/2}$). The resulting perimeter and circle equivalent diameter were used to calculate the specific perimeter (perimeter/circle equivalent diameter). Such an operation was performed for 500 of the electro-conductive particles, and the arithmetic mean value was defined as the specific perimeter of the electro-conductive particle. The results are shown in Table 6.

<5. Image Evaluation>

The following image evaluation was performed in an ordinary-temperature and ordinary-humidity environment of a temperature of 23° C. and a relative humidity of 50%, and in a high-temperature and high-humidity environment (temperature: 30° C.; relative humidity: 80%) and in a low-temperature and low-humidity environment (temperature: 15° C.; relative humidity: 10%). First, a gear as a toner feed roller was removed from a process cartridge (trade name: HP 410X High Yield Magenta Original LaserJet Toner Cartridge (CF413X), manufactured by Hewlett-Packard Company), for the purpose of a reduction in torque of an electrophotographic member. The toner feed roller is rotated in natural in an inverse direction against a developing roller during an operation of the process cartridge. The gear, however, is removed to thereby allow the toner feed roller to be driven according to the developing roller. While a low torque is thus obtained, the amount of toner fed to the developing roller is decreased. Next, the developing roller produced was incorporated into the process cartridge, and the process cartridge was mounted to a laser beam printer (trade name: Color Laser Jet Pro M452dw, manufactured by Hewlett-Packard Company) as an image forming apparatus. Next, the laser beam printer was aged in an image evaluation environment for 24 hours or more and 48 hours or less.

(Image Evaluation 5-1. Evaluation of Toner Conveying Force)

After the aging, a black solid (density: 100%) image was output on A4-sized paper for one sheet in the same environment. The image density of the resulting black solid image was measured with a spectroscopic densitometer (trade name: 508, manufactured by X-Rite Inc.), and the difference in density between the leading end and the tail end of the image in the conveyance direction of the A4-sized paper was determined. The evaluation criteria of the difference in image density are as follows. The results are represented as "toner conveying force" in Table 7.

Rank A: the difference in image density was less than 0.05, and the toner conveying force was very high.

Rank B: the difference in image density was 0.05 or more and less than 0.10, and the toner conveying force was high.

Rank C: the difference in image density was 0.10 or more and less than 0.20, and the toner conveying force was within the acceptance range.

Rank D: the difference in image density was 0.20 or more, and the toner conveying force was low.

(Image Evaluation 5-2. Evaluation of Change in Image Density)

After the aging, a halftone (density: 50%) image was output on one A4-sized sheet in the same environment. The image density of the resulting halftone image was measured with the spectroscopic densitometer. Next, a white solid (density: 0%) image was output on 1000 A4-sized sheets, and thereafter a halftone (density: 50%) image was rapidly output on one A4-sized sheet. The image density of the resulting halftone image was similarly measured, and the difference between the respective densities before and after outputting for 1000 sheets was determined. The evaluation criteria of the difference in image density are as follows. The results are represented as "change in image density" in Table 7.

Rank A: the difference in image density was less than 0.05, and the change in image density was very small.

Rank B: the difference in image density was 0.05 or more and less than 0.10, and the change in image density was small.

Rank C: the difference in image density was 0.10 or more and less than 0.20, and the change in image density was within the acceptance range.

Rank D: the difference in image density was 0.20 or more, and the change in image density was large.

Examples 2 to 50 and Comparative Examples 1 to 10

<1. Production of Conductive Elastic Roller>

An axial core made of stainless steel (SUS 304) having an outer diameter of 6 mm and a length of 260 mm was coated with a primer (trade name: DY35-051, manufactured by Dow Corning Toray Co., Ltd.) and baked to prepare a substrate. Materials represented in Table 2 below were kneaded to prepare an unvulcanized rubber composition. Next, a crosshead extruder having a mechanism for feeding the substrate and a mechanism for discharging the unvulcanized rubber composition was prepared, a die having an inner diameter of 10.1 mm was attached to the crosshead, and the temperatures of the extruder and the crosshead were adjusted to 30° C. and the speed of conveyance of the substrate was adjusted to 60 mm/sec. The unvulcanized rubber composition was fed from the extruder in such conditions, to cover the outer periphery of the substrate with the unvulcanized rubber composition serving as an elastic layer, in the crosshead, thereby providing an unvulcanized rubber roller. Next, the unvulcanized rubber roller was loaded to a hot air vulcanizing furnace at 170° C., and heated for 15 minutes. Thereafter, the resultant was polished using a GC80 grind stone with a rotational polisher (trade name: LEO-600-F4L-BME, manufactured by Minakuchi Machinery Works Ltd.), thereby producing conductive elastic roller 2 including an electro-conductive elastic layer having a thickness of 2.0 mm on the outer periphery of the axial core.

TABLE 2

| Material | parts by mass |
|---|---|
| Millable silicone rubber material (trade name: TSE270-4U, manufactured by Momentive Performance Materials Japan LLC) | 100 |
| Carbon black (trade name: Tokablack #7360SB: manufactured by Tokai Carbon Co., Ltd.) | 10 |
| Curing agent (trade name: TC-8: manufactured by Momentive Performance Materials Japan LLC) | 0.5 |

<2. Preparation of Coating Liquids G-2 to G-58>

The polyol used for preparation of isocyanate group-terminated prepolymer B-1 in Example 1 was changed to each polyol described in Table 3. The same manner was performed as in isocyanate group-terminated prepolymer B-1 except for such a change, thereby preparing each of isocyanate group-terminated prepolymers B-2 to B-5 having an isocyanate group content of 4.3% by mol. The same manner was performed as in coating liquid G-1 except that the composition was changed to each composition represented in Table 3 to adjust the solid content for an objective thickness of a covering layer, thereby preparing each of coating liquids G-2 to G-58. Table 4 shows specific material names of polyol A, isocyanate group-terminated prepolymer B, conductive particle C and insulating particle D described in Table 3. In Table 3, "parts" means "parts by mass".

<3. Production of Developing Roller>

The same manner was performed as in Example 1 except that the coating liquid for use in covering layer formation was changed as described in Table 3, thereby producing each of developing rollers X-2 to X-49 and Y-2 to Y-9. The same manner was performed as in Example 1 except that conductive elastic roller 1 was changed to conductive elastic roller 2, thereby producing developing roller X-50.

The surface of a roller produced in the same manner as in Example 1 except that the coating liquid for use in covering layer formation was changed to G-50 was polished with a rubber roll mirror finishing machine (trade name: SZC, manufactured by Minakuchi Machinery Works Ltd.) to partially expose the insulating particle, thereby producing developing roller Y-1.

The same manner was performed as in conductive elastic roller 1 except that the carbon black in conductive elastic roller 1 was changed to carbon particle C-1 (trade name: ICB 0520, manufactured by Nippon Carbon Co., Ltd.), thereby producing conductive elastic roller 3 (developing roller Y-10) including a covering layer having a thickness of 2.0 mm on the outer periphery of the axial core.

Table 3 describes combinations of conductive elastic rollers and coating liquids of developing rollers X-2 to X-50 and Y-1 to Y-10. Developing rollers X-2 to X50 and Y-1 to Y-10 were evaluated in the same manner as in Example 1. The results are shown in Table 5 to Table 7. Herein, Y-1 and Y-3, having a small average primary particle size of the carbon black as the electro-conductive particle and having a difficulty in measurement of the nano-indenter hardness of the matrix, the nano-indenter hardness on the electro-conductive particle and the potential decay time constant of the matrix, were thus evaluated without any distinguishing of the matrix from the electro-conductive particle. The results are represented as "hardness" and "potential decay time constant" of the matrix, in Table 6.

TABLE 3

| | | | Polyol A | | Isocyanate B | | Conductive particle C | | Insulating particle D | |
|---|---|---|---|---|---|---|---|---|---|---|
| Developing roller | Conductive elastic roller | Coating liquid | Type | Amount added (parts) | Type | Amount added (parts) | Type | Amount added (parts) | Type | Amount added (parts) |
| X-1 | 1 | G-1 | A-1 | 45 | B-1 | 55 | C-1 | 80 | — | — |
| X-2 | 1 | G-2 | A-1 | 45 | B-1 | 55 | C-1 | 40 | — | — |
| X-3 | 1 | G-3 | A-1 | 45 | B-1 | 55 | C-1 | 60 | — | — |
| X-4 | 1 | G-4 | A-1 | 45 | B-1 | 55 | C-1 | 100 | — | — |
| X-5 | 1 | G-5 | A-1 | 45 | B-1 | 55 | C-1 | 120 | — | — |
| X-6 | 1 | G-6 | A-1 | 45 | B-1 | 55 | C-2 | 80 | — | — |
| X-7 | 1 | G-7 | A-1 | 45 | B-1 | 55 | C-3 | 80 | — | — |
| X-8 | 1 | G-8 | A-1 | 45 | B-1 | 55 | C-4 | 80 | — | — |
| X-9 | 1 | G-9 | A-2 | 47 | B-2 | 57 | C-1 | 80 | — | — |
| X-10 | 1 | G-10 | A-2 | 47 | B-2 | 57 | C-1 | 40 | — | — |
| X-11 | 1 | G-11 | A-2 | 47 | B-2 | 57 | C-1 | 60 | — | — |
| X-12 | 1 | G-12 | A-2 | 47 | B-2 | 57 | C-1 | 100 | — | — |
| X-13 | 1 | G-13 | A-2 | 47 | B-2 | 57 | C-1 | 120 | — | — |
| X-14 | 1 | G-14 | A-2 | 47 | B-2 | 57 | C-2 | 80 | — | — |
| X-15 | 1 | G-15 | A-2 | 47 | B-2 | 57 | C-3 | 80 | — | — |
| X-16 | 1 | G-16 | A-2 | 47 | B-2 | 57 | C-4 | 80 | — | — |
| X-17 | 1 | G-17 | A-3 | 18 | B-3 | 82 | C-1 | 80 | — | — |
| X-18 | 1 | G-18 | A-3 | 18 | B-3 | 82 | C-1 | 40 | — | — |

TABLE 3-continued

| Developing roller | Conductive elastic roller | Coating liquid | Polyol A Type | Polyol A Amount added (parts) | Isocyanate B Type | Isocyanate B Amount added (parts) | Conductive particle C Type | Conductive particle C Amount added (parts) | Insulating particle D Type | Insulating particle D Amount added (parts) |
|---|---|---|---|---|---|---|---|---|---|---|
| X-19 | 1 | G-19 | A-3 | 18 | B-3 | 82 | C-1 | 60 | — | — |
| X-20 | 1 | G-20 | A-3 | 18 | B-3 | 82 | C-1 | 100 | — | — |
| X-21 | 1 | G-21 | A-3 | 18 | B-3 | 82 | C-1 | 120 | — | — |
| X-22 | 1 | G-22 | A-3 | 18 | B-3 | 82 | C-2 | 80 | — | — |
| X-23 | 1 | G-23 | A-3 | 18 | B-3 | 82 | C-3 | 80 | — | — |
| X-24 | 1 | G-24 | A-3 | 18 | B-3 | 82 | C-4 | 80 | — | — |
| X-25 | 1 | G-25 | A-1 | 45 | B-1 | 55 | C-5 | 60 | — | — |
| X-26 | 1 | G-26 | A-1 | 45 | B-1 | 55 | C-6 | 80 | — | — |
| X-27 | 1 | G-27 | A-1 | 45 | B-1 | 55 | C-7 | 120 | — | — |
| X-28 | 1 | G-28 | A-1 | 45 | B-1 | 55 | C-8 | 80 | — | — |
| X-29 | 1 | G-29 | A-1 | 45 | B-1 | 55 | C-9 | 80 | — | — |
| X-30 | 1 | G-30 | A-2 | 47 | B-2 | 57 | C-5 | 60 | — | — |
| X-31 | 1 | G-31 | A-2 | 47 | B-2 | 57 | C-6 | 80 | — | — |
| X-32 | 1 | G-32 | A-2 | 47 | B-2 | 57 | C-7 | 120 | — | — |
| X-33 | 1 | G-33 | A-2 | 47 | B-2 | 57 | C-8 | 80 | — | — |
| X-34 | 1 | G-34 | A-2 | 47 | B-2 | 57 | C-9 | 80 | — | — |
| X-35 | 1 | G-35 | A-3 | 18 | B-3 | 82 | C-5 | 60 | — | — |
| X-36 | 1 | G-36 | A-3 | 18 | B-3 | 82 | C-6 | 80 | — | — |
| X-37 | 1 | G-37 | A-3 | 18 | B-3 | 82 | C-7 | 120 | — | — |
| X-38 | 1 | G-38 | A-3 | 18 | B-3 | 82 | C-8 | 80 | — | — |
| X-39 | 1 | G-39 | A-3 | 18 | B-3 | 82 | C-9 | 80 | — | — |
| X-40 | 1 | G-40 | A-1 | 43 | B-4 | 57 | C-1 | 80 | — | — |
| X-41 | 1 | G-41 | A-4 | 45 | B-4 | 55 | C-1 | 80 | — | — |
| X-42 | 1 | G-42 | A-1 | 45 | B-1 | 55 | C-1 | 80 | — | — |
| X-43 | 1 | G-43 | A-1 | 45 | B-1 | 55 | C-3 | 80 | — | — |
| X-44 | 1 | G-44 | A-1 | 45 | B-1 | 55 | C-3 | 80 | — | — |
| X-45 | 1 | G-45 | A-1 | 45 | B-1 | 55 | C-2 | 80 | — | — |
| X-46 | 1 | G-46 | A-1 | 45 | B-1 | 55 | C-4 | 80 | — | — |
| X-47 | 1 | G-47 | A-1 | 45 | B-1 | 55 | C-1 | 80 | D-1 | 10 |
| X-48 | 1 | G-48 | A-1 | 45 | B-1 | 55 | C-1 | 80 | D-2 | 10 |
| X-49 | 1 | G-49 | A-1 | 45 | B-1 | 55 | C-1 | 80 | D-3 | 10 |
| X-50 | 2 | G-1 | A-1 | 45 | B-1 | 55 | C-1 | 80 | — | — |
| Y-1 | 1 | G-50 | A-5 | 50 | B-5 | 50 | C-10 | 40 | D-4 | 100 |
| Y-2 | 1 | G-51 | A-5 | 50 | B-5 | 50 | C-1 | 40 | — | — |
| Y-3 | 1 | G-52 | A-3 | 18 | B-3 | 82 | C-10 | 40 | — | — |
| Y-4 | 1 | G-53 | A-3 | 18 | B-3 | 82 | C-11 | 60 | — | — |
| Y-5 | 1 | G-54 | A-3 | 20 | B-5 | 80 | C-1 | 80 | — | — |
| Y-6 | 1 | G-55 | A-3 | 18 | B-3 | 82 | C-4 | 20 | — | — |
| Y-7 | 1 | G-56 | A-3 | 18 | B-3 | 82 | C-2 | 150 | — | — |
| Y-8 | 1 | G-57 | A-3 | 18 | B-3 | 82 | C-1 | 120 | — | — |
| Y-9 | 1 | G-58 | A-3 | 18 | B-3 | 82 | C-12 | 40 | — | — |
| Y-10 | 3 | — | — | — | — | — | — | — | — | — |

TABLE 4

| | Compound name | Structural formula number |
|---|---|---|
| A-1 | Hydrogenerated polyisoprene polyol (trade name: Epol, manufactured by Idemitsu Kosan Co., Ltd.) | (1), (4) |
| A-2 | Polycarbonate polyol (trade name: Duranol T5652, manufactured by Asahi Kasei Corporation) | |
| A-3 | Amine-based polyol (trade name: NP-400, manufactured by Sanyo Chemicals Industries, Ltd.) | |
| A-4 | Polyisoprene polyol (trade name: Poly ip, manufactured by Idemitsu Kosan Co., Ltd.) | (1), (3) |
| A-5 | Polyether polyol (trade name: PTMG2000, manufactured by Mitsubishi Chemical Corporation) | |
| B-1 | Polybutadiene polyol/polymeric MDI (trade name: G2000, manufactured by Nippon Soda Co., Ltd./trade name: Millionate MR200, manufactured by Tosoh Corporation) | (1)/(5) |
| B-2 | Polycarbonate polyol/polymeric MDI (trade name: Duranol T5652, manufactured by Asahi Kasei Corporation/trade name: Millionate MR200, manufactured by Tosoh Corporation) | |
| B-3 | Polyether-based polyol/polymeric MDI (trade name: PTG-L3500, manufactured by Hodogaya Chemical Co., Ltd./trade name: Millionate MR200, manufactured by Tosoh Corporation) | |
| B-4 | Hydrogenerated polybutadiene polyol/polymeric MDI (trade name: GI2000, manufactured by Nippon Soda Co., Ltd./trade name: Millionate MR200, manufactured by Tosoh Corporation) | (2)/(5) |

TABLE 4-continued

| | Compound name | Structural formula number |
|---|---|---|
| B-5 | Polyester-modified isocyanate (trade name: Coronate L, manufactured by Tosoh Corporation) | |
| C-1 | Carbon particle (trade name: ICB 0520, average particle size: 5.0 μm, manufactured by Nippon Carbon Co., Ltd., longer diameter/shorter diameter: 1.05) | |
| C-2 | Carbon particle (trade name: ICB 0320, average particle size: 3.0 μm, manufactured by Nippon Carbon Co., Ltd., longer diameter/shorter diameter: 1.02) | |
| C-3 | Carbon particle (trade name: ICB 1020, average particle size: 10.0 μm, manufactured by Nippon Carbon Co., Ltd., longer diameter/shorter diameter: 1.05) | |
| C-4 | Carbon particle (trade name: ICB 3020 (classified product), average particle size: 20 μm, manufactured by Nippon Carbon Co., Ltd., longer diameter/shorter diameter: 1.07) | |
| C-5 | Carbon black-encapsulated acrylic particle (trade name: GR004BK, average particle size: 4.0 μm, manufactured by Negami Chemical Industrial Co., Ltd., longer diameter/shorter diameter: 1.05) | |
| C-6 | Pitch-coated carbon particle (trade name: PC520, average particle size: 6.0 μm, manufactured by Nippon Carbon Co., Ltd., longer diameter/shorter diameter: 1.13) | |
| C-7 | Ag-plated silica particle (trade name: TFM-S05P, average particle size: 6.0 μm, manufactured by Toyo Aluminum K.K., longer diameter/shorter diameter: 1.02) | |
| C-8 | Au-coating resin particle (trade name: Micropearl AU, average particle size: 7.3 μm, manufactured by Sekisui Plastics Co., Ltd., longer diameter/shorter diameter: 1.02) | |
| C-9 | Carbon black-coating carbon particle (trade name: MC2020, average particle size: 20 μm, manufactured by Nippon Carbon Co., Ltd., longer diameter/shorter diameter: 1.1) | |
| C-10 | Carbon black (trade name: MA100, average primary particle size: 24 nm, Mitsubishi Chemical Corporation) | |
| C-11 | Carbon black coating urethane particle (trade name: HB800BK, average particle size: 6.0 μm, manufactured by Negami Chemical Industrial Co., Ltd., longer diameter/shorter diameter: 1.03) | |
| C-12 | Spherical graphite particle (trade name: SG-BL40, average particle size: 40 μm, manufactured by Ito Graphite Co., Ltd., longer diameter/shorter diameter: 1.3) | |
| D-1 | Urethane particle (trade name: Dynamic Beads UCN-5150D, average particle size: 15 μm, manufactured by Dainichiseika Color & Chemicals Mfg. Co., Ltd.) | |
| D-2 | Urethane particle (trade name: Dynamic Beads UCN-5090D, average particle size: 9.0 μm, manufactured by Dainichiseika Color & Chemicals Mfg. Co., Ltd.) | |
| D-3 | Urethane particle (trade name: Dynamic Beads UCN-5070D, average particle size: 7.0 μm, manufactured by Dainichiseika Color & Chemicals Mfg. Co., Ltd.) | |
| D-4 | Acrylic particle (trade name: Techpolymer MBX-50, average particle size: 50 μm, manufactured by Sekisui Plastics Co., Ltd.) | |

TABLE 5

| | | | Current value in non-pressing | | Conductive | Surface potential | | Volume resistivity of roller in pressing | |
|---|---|---|---|---|---|---|---|---|---|
| | | Developing roller | Arithmetic mean value (pA) | Standard deviation (pA) | point density in pressing, (point(s)/100 μm□) | Arithmetic mean value (V) | Standard deviation (V) | Arithmetic mean value (Ω · cm) | Standard deviation (Ω · cm) |
| Example | 1 | X-1 | 251 | 14 | 22 | 40 | 6.0 | 4.E+07 | 6.E+08 |
| | 2 | X-2 | 258 | 13 | 15 | 90 | 5.5 | 2.E+07 | 2.E+07 |
| | 3 | X-3 | 259 | 13 | 20 | 65 | 5.9 | 2.E+07 | 4.E+08 |
| | 4 | X-4 | 257 | 13 | 22 | 33 | 5.5 | 2.E+07 | 4.E+06 |
| | 5 | X-5 | 267 | 14 | 23 | 22 | 4.9 | 5.E+07 | 4.E+07 |
| | 6 | X-6 | 253 | 14 | 25 | 64 | 4.9 | 4.E+07 | 4.E+08 |
| | 7 | X-7 | 267 | 14 | 15 | 63 | 7.0 | 7.E+07 | 5.E+08 |
| | 8 | X-8 | 265 | 14 | 10 | 65 | 9.0 | 6.E+07 | 4.E+08 |
| | 9 | X-9 | 255 | 13 | 20 | 31 | 4.0 | 2.E+06 | 3.E+07 |
| | 10 | X-10 | 267 | 14 | 13 | 50 | 3.8 | 3.E+06 | 5.E+07 |
| | 11 | X-11 | 265 | 14 | 18 | 43 | 3.9 | 4.E+06 | 1.E+07 |
| | 12 | X-12 | 261 | 14 | 21 | 25 | 3.8 | 2.E+06 | 4.E+07 |
| | 13 | X-13 | 271 | 15 | 22 | 19 | 3.6 | 7.E+06 | 9.E+07 |
| | 14 | X-14 | 266 | 13 | 25 | 31 | 4.0 | 6.E+06 | 2.E+07 |
| | 15 | X-15 | 272 | 15 | 15 | 29 | 5.5 | 5.E+06 | 3.E+07 |
| | 16 | X-16 | 259 | 13 | 10 | 23 | 6.5 | 7.E+06 | 3.E+07 |
| | 17 | X-17 | 260 | 13 | 20 | 30 | 3.8 | 4.E+06 | 1.E+07 |
| | 18 | X-18 | 255 | 14 | 13 | 40 | 3.3 | 2.E+04 | 3.E+05 |
| | 19 | X-19 | 260 | 13 | 18 | 25 | 3.6 | 5.E+06 | 1.E+07 |
| | 20 | X-20 | 273 | 15 | 21 | 20 | 3.5 | 6.E+06 | 1.E+08 |

TABLE 5-continued

| | | Developing roller | Current value in non-pressing: Arithmetic mean value (pA) | Current value in non-pressing: Standard deviation (pA) | Conductive point density in pressing, (point(s)/100 μm□) | Surface potential: Arithmetic mean value (V) | Surface potential: Standard deviation (V) | Volume resistivity of roller in pressing: Arithmetic mean value (Ω · cm) | Volume resistivity of roller in pressing: Standard deviation (Ω · cm) |
|---|---|---|---|---|---|---|---|---|---|
| | 21 | X-21 | 269 | 14 | 22 | 18 | 3.3 | 9.E+06 | 2.E+08 |
| | 22 | X-22 | 268 | 15 | 258 | 23 | 3.4 | 6.E+06 | 3.E+07 |
| | 23 | X-23 | 260 | 14 | 15 | 23 | 4.8 | 8.E+05 | 2.E+06 |
| | 24 | X-24 | 274 | 15 | 10 | 22 | 5.0 | 4.E+05 | 5.E+06 |
| | 25 | X-25 | 256 | 13 | 23 | 38 | 3.9 | 2.E+06 | 6.E+06 |
| | 26 | X-26 | 267 | 14 | 20 | 40 | 5.0 | 2.E+07 | 1.E+08 |
| | 27 | X-27 | 260 | 13 | 19 | 38 | 3.9 | 6.E+06 | 8.E+06 |
| | 28 | X-28 | 273 | 14 | 19 | 38 | 3.9 | 4.E+06 | 3.E+07 |
| | 29 | X-29 | 265 | 14 | 22 | 39 | 3.8 | 4.E+06 | 2.E+07 |
| | 30 | X-30 | 262 | 14 | 22 | 30 | 3.7 | 1.E+06 | 2.E+07 |
| | 31 | X-31 | 260 | 14 | 20 | 30 | 3.9 | 6.E+06 | 7.E+07 |
| | 32 | X-32 | 250 | 13 | 18 | 30 | 3.7 | 7.E+06 | 3.E+06 |
| | 33 | X-33 | 274 | 14 | 19 | 28 | 3.7 | 1.E+07 | 2.E+08 |
| | 34 | X-34 | 265 | 13 | 22 | 28 | 3.5 | 1.E+06 | 8.E+06 |
| | 35 | X-35 | 251 | 13 | 23 | 27 | 3.6 | 6.E+06 | 1.E+08 |
| | 36 | X-36 | 267 | 14 | 20 | 28 | 3.7 | 7.E+06 | 5.E+06 |
| | 37 | X-37 | 258 | 14 | 19 | 29 | 3.6 | 9.E+06 | 8.E+07 |
| | 38 | X-38 | 260 | 14 | 18 | 28 | 3.7 | 7.E+06 | 8.E+06 |
| | 39 | X-39 | 264 | 14 | 22 | 27 | 3.5 | 7.E+06 | 1.E+08 |
| | 40 | X-40 | 267 | 14 | 22 | 36 | 6.0 | 9.E+07 | 1.E+09 |
| | 41 | X-41 | 251 | 13 | 23 | 38 | 6.1 | 2.E+07 | 6.E+07 |
| | 42 | X-42 | 273 | 14 | 22 | 19 | 5.0 | 5.E+07 | 5.E+08 |
| | 43 | X-43 | 263 | 14 | 15 | 59 | 5.8 | 7.E+06 | 2.E+07 |
| | 44 | X-44 | 260 | 13 | 14 | 77 | 7.1 | 2.E+07 | 2.E+08 |
| | 45 | X-45 | 267 | 14 | 26 | 38 | 5.5 | 3.E+07 | 5.E+08 |
| | 46 | X-46 | 269 | 14 | 10 | 37 | 10.7 | 6.E+06 | 7.E+07 |
| | 47 | X-47 | 274 | 14 | 18 | 47 | 7.0 | 3.E+07 | 1.E+08 |
| | 48 | X-48 | 271 | 14 | 18 | 44 | 8.2 | 4.E+07 | 5.E+08 |
| | 49 | X-49 | 257 | 13 | 18 | 45 | 9.0 | 4.E+07 | 6.E+08 |
| | 50 | X-50 | 257 | 13 | 22 | 43 | 6.0 | 3.E+07 | 7.E+08 |
| Comparative Example | 1 | Y-1 | 1073 | 10973 | — | 30 | 4.1 | 3.E+07 | 5.E+05 |
| | 2 | Y-2 | 1099 | 55 | — | 2 | 1.1 | 9.E+07 | 5.E+08 |
| | 3 | Y-3 | 10561 | 535 | — | 0 | 0.1 | 8.E+07 | 1.E+09 |
| | 4 | Y-4 | 259 | 13 | 0 | 30 | 3.5 | 8.E+12 | 4.E+09 |
| | 5 | Y-5 | 270 | 15 | 0 | 29 | 3.5 | 9.E+12 | 4.E+11 |
| | 6 | Y-6 | 251 | 13 | 5 | 98 | 3.0 | 7.E+11 | 1.E+09 |
| | 7 | Y-7 | 529 | 1695 | 40 | 7 | 2.2 | 7.E+05 | 1.E+07 |
| | 8 | Y-8 | 267 | 14 | 24 | 40 | 2.2 | 6.E+06 | 1.E+08 |
| | 9 | Y-9 | 263 | 14 | 6 | 65 | 3.0 | 2.E+08 | 8.E+06 |
| | 10 | Y-10 | 273 | 14 | 10 | 15 | 1.0 | 6.E+06 | 1.E+08 |

TABLE 6

| | | Developing roller | Matrix: Covering layer: Thickness (μm) | Matrix: Covering layer: Roughness (μm) | Matrix: Potential decay time constant (min) | Matrix: Hardness (N/mm$^2$) | Conductive particle: Hardness (N/mm$^2$) | Conductive particle: Particle size (μm) | Conductive particle: Content (% by volume) | Conductive particle: Stacking (number) | Conductive particle: Specific perimeter (–) |
|---|---|---|---|---|---|---|---|---|---|---|---|
| Example | 1 | X-1 | 10.9 | 0.9 | 12.7 | 0.7 | 2.3 | 5.0 | 35 | 1.2 | 1.01 |
| | 2 | X-2 | 10.4 | 0.7 | 10.6 | 0.6 | 2.6 | 5.2 | 20 | 0.8 | 1.01 |
| | 3 | X-3 | 11.0 | 0.8 | 11.1 | 0.7 | 2.3 | 4.9 | 28 | 1 | 1.02 |
| | 4 | X-4 | 10.5 | 1.1 | 12.4 | 0.9 | 2.6 | 5.1 | 41 | 1.4 | 1.02 |
| | 5 | X-5 | 10.1 | 1.4 | 10.2 | 0.9 | 2.7 | 5.0 | 45 | 1.5 | 1.02 |
| | 6 | X-6 | 10.8 | 0.7 | 11.6 | 0.7 | 2.5 | 3.0 | 34 | 2 | 1.05 |
| | 7 | X-7 | 10.0 | 1.4 | 11.4 | 0.7 | 2.4 | 10.1 | 34 | 0.9 | 1.04 |
| | 8 | X-8 | 10.1 | 1.8 | 12.1 | 0.7 | 2.3 | 20.0 | 34 | 0.9 | 1.05 |
| | 9 | X-9 | 10.1 | 1.6 | 5.9 | 0.9 | 3.5 | 5.2 | 34 | 1.2 | 1.02 |
| | 10 | X-10 | 10.6 | 1.2 | 6.4 | 0.9 | 2.9 | 5.2 | 21 | 0.8 | 1.02 |
| | 11 | X-11 | 10.6 | 1.4 | 5.2 | 1.0 | 3.3 | 5.1 | 29 | 1 | 1.02 |
| | 12 | X-12 | 10.5 | 1.9 | 5.9 | 1.0 | 3.5 | 5.2 | 41 | 1.4 | 1.02 |
| | 13 | X-13 | 10.6 | 2.5 | 6.0 | 1.3 | 3.5 | 4.8 | 45 | 1.5 | 1.01 |
| | 14 | X-14 | 10.0 | 1.2 | 5.5 | 1.0 | 2.9 | 2.9 | 34 | 2 | 1.05 |
| | 15 | X-15 | 10.7 | 2.4 | 5.1 | 0.9 | 3.2 | 10.4 | 35 | 0.9 | 1.03 |
| | 16 | X-16 | 10.7 | 3 | 5.9 | 1.0 | 3.4 | 19.5 | 35 | 0.9 | 1.05 |
| | 17 | X-17 | 10.3 | 1.7 | 1.6 | 2.6 | 3.6 | 5.2 | 34 | 1.2 | 1.02 |

TABLE 6-continued

| | | | Matrix | | | | Conductive particle | | | | |
|---|---|---|---|---|---|---|---|---|---|---|---|
| | | | Covering layer | | Potential decay time | | | Particle | Content | | Specific |
| | | Developing roller | Thickness (μm) | Roughness (μm) | constant (min) | Hardness ($N/mm^2$) | Hardness ($N/mm^2$) | size (μm) | (% by volume) | Stacking (number) | perimeter (–) |
| | 18 | X-18 | 10.5 | 1.3 | 1.5 | 2.3 | 4.3 | 5.2 | 20 | 0.8 | 1.01 |
| | 19 | X-19 | 10.8 | 1.5 | 1.6 | 2.4 | 4.0 | 5.2 | 28 | 1 | 1.02 |
| | 20 | X-20 | 10.9 | 2 | 2.0 | 2.7 | 3.6 | 4.8 | 41 | 1.4 | 1.01 |
| | 21 | X-21 | 10.5 | 2.6 | 1.7 | 2.6 | 4.3 | 4.8 | 45 | 1.5 | 1.01 |
| | 22 | X-22 | 10.8 | 1.3 | 1.9 | 2.5 | 4.0 | 3.1 | 35 | 2 | 1.05 |
| | 23 | X-23 | 10.4 | 2.5 | 1.6 | 2.2 | 4.2 | 9.5 | 34 | 0.9 | 1.03 |
| | 24 | X-24 | 10.5 | 3.1 | 1.7 | 2.3 | 4.4 | 19.3 | 35 | 0.9 | 1.05 |
| | 25 | X-25 | 10.4 | 2 | 12.4 | 0.6 | 1.2 | 3.8 | 35 | 1.5 | 1.21 |
| | 26 | X-26 | 10.1 | 1.2 | 12.8 | 0.7 | 2.4 | 5.1 | 34 | 1.3 | 1.10 |
| | 27 | X-27 | 10.7 | 2 | 11.3 | 0.7 | 3.0 | 6.0 | 36 | 1.2 | 1.03 |
| | 28 | X-28 | 10.9 | 2 | 13.5 | 0.7 | 2.6 | 6.8 | 35 | 1 | 1.03 |
| | 29 | X-29 | 10.3 | 2.3 | 10.4 | 0.6 | 2.6 | 4.8 | 35 | 1.2 | 2.32 |
| | 30 | X-30 | 10.1 | 2.2 | 5.2 | 0.9 | 1.7 | 3.9 | 35 | 1.5 | 1.20 |
| | 31 | X-31 | 10.8 | 1.5 | 5.0 | 0.9 | 3.2 | 5.2 | 35 | 1.3 | 1.10 |
| | 32 | X-32 | 10.4 | 2.1 | 6.6 | 0.9 | 3.9 | 6.1 | 34 | 1.2 | 1.03 |
| | 33 | X-33 | 10.2 | 2.1 | 5.9 | 0.9 | 3.7 | 7.1 | 34 | 1 | 1.02 |
| | 34 | X-34 | 10.2 | 2.5 | 5.8 | 1.0 | 3.4 | 5.1 | 34 | 1.2 | 2.30 |
| | 35 | X-35 | 10.1 | 2.2 | 1.5 | 2.5 | 2.8 | 3.8 | 35 | 1.5 | 1.21 |
| | 36 | X-36 | 10.5 | 1.5 | 1.6 | 2.6 | 4.5 | 4.8 | 35 | 1.3 | 1.10 |
| | 37 | X-37 | 10.1 | 2.1 | 1.7 | 2.4 | 4.5 | 6.2 | 35 | 1.2 | 1.02 |
| | 38 | X-38 | 10.0 | 2.1 | 1.8 | 2.5 | 4.1 | 7.0 | 35 | 1 | 1.03 |
| | 39 | X-39 | 10.7 | 2.5 | 2.0 | 2.5 | 4.6 | 5.1 | 34 | 1.2 | 2.32 |
| | 40 | X-40 | 11.0 | 0.9 | 20.6 | 0.7 | 2.5 | 4.8 | 35 | 1.2 | 1.02 |
| | 41 | X-41 | 10.8 | 0.9 | 17.8 | 0.7 | 2.4 | 5.0 | 35 | 1.2 | 1.01 |
| | 42 | X-42 | 3.0 | 1.3 | 13.5 | 0.7 | 2.7 | 5.0 | 35 | 0.8 | 1.01 |
| | 43 | X-43 | 20.0 | 0.9 | 12.2 | 0.7 | 2.5 | 10.3 | 34 | 1.2 | 1.04 |
| | 44 | X-44 | 30.0 | 0.8 | 11.9 | 0.7 | 2.3 | 10.2 | 36 | 1.5 | 1.03 |
| | 45 | X-45 | 3.1 | 1.1 | 12.0 | 0.7 | 2.7 | 3.0 | 36 | 1 | 1.05 |
| | 46 | X-46 | 29.9 | 1.3 | 11.3 | 0.7 | 2.6 | 19.9 | 35 | 1.1 | 1.05 |
| | 47 | X-47 | 10.1 | 1.1 | 12.2 | 0.7 | 2.7 | 5.2 | 31 | 1 | 1.02 |
| | 48 | X-48 | 10.4 | 1.3 | 10.5 | 0.7 | 2.6 | 5.2 | 32 | 1 | 1.01 |
| | 49 | X-49 | 10.1 | 1.4 | 13.3 | 0.7 | 2.4 | 4.9 | 32 | 1 | 1.01 |
| | 50 | X-50 | 10.2 | 0.9 | 13.1 | 0.8 | 2.3 | 5.1 | 34 | 1.2 | 1.01 |
| Comparative | 1 | Y-1 | 10.7 | 2.5 | 5.2 | 1.6 | — | 0.02 | 22 | — | — |
| Example | 2 | Y-2 | 10.4 | 1.8 | 0.1 | 0.6 | 2.6 | 4.9 | 21 | 0.9 | 1.01 |
| | 3 | Y-3 | 10.2 | 0.6 | 0.0 | 3.5 | — | 0.02 | 24 | — | — |
| | 4 | Y-4 | 10.5 | 2.6 | 1.5 | 2.5 | 1.5 | 8.4 | 34 | 1 | 3.11 |
| | 5 | Y-5 | 10.4 | 2 | 8.6 | 7.7 | 9.5 | 5.0 | 36 | 1.2 | 1.01 |
| | 6 | Y-6 | 10.0 | 1.6 | 1.7 | 2.2 | 4.3 | 19.8 | 12 | 0.4 | 1.05 |
| | 7 | Y-7 | 10.2 | 1.4 | 1.8 | 2.9 | 3.9 | 3.0 | 51 | 3.1 | 1.05 |
| | 8 | Y-8 | 50.3 | 1.6 | 1.7 | 2.7 | 3.8 | 3.1 | 45 | 5.3 | 1.01 |
| | 9 | Y-9 | 50.9 | 1.4 | 1.9 | 2.2 | 2.4 | 39.4 | 21 | 1.1 | 1.30 |
| | 10 | Y-10 | 2000 | 0.5 | 7.1 | 0.2 | 1.1 | 19.7 | 33 | 10.1 | 1.01 |

TABLE 7

| | | | Temperature: 23° C.; relative humidity: 50% | | High-temperature and high-humidity | | Low-temperature and low-humidity | |
|---|---|---|---|---|---|---|---|---|
| | | Developing roller | Toner conveying force | Change in image density | Toner conveying force | Change in image density | Toner conveying force | Change in image density |
| Example | 1 | X-1 | A | A | A | A | A | A |
| | 2 | X-2 | A | A | A | A | A | B |
| | 3 | X-3 | A | A | A | A | A | A |
| | 4 | X-4 | A | A | A | A | A | A |
| | 5 | X-5 | A | A | B | A | A | A |
| | 6 | X-6 | A | A | B | A | A | A |
| | 7 | X-7 | A | A | A | A | A | B |
| | 8 | X-8 | A | B | A | B | A | B |
| | 9 | X-9 | B | A | B | A | A | A |
| | 10 | X-10 | C | B | C | B | B | C |
| | 11 | X-11 | B | A | B | A | B | B |
| | 12 | X-12 | C | A | C | A | B | A |
| | 13 | X-13 | C | A | C | A | B | A |
| | 14 | X-14 | B | A | B | A | A | A |
| | 15 | X-15 | A | B | A | A | A | B |

TABLE 7-continued

| | | Developing roller | Temperature: 23° C.; relative humidity: 50% | | High-temperature and high-humidity | | Low-temperature and low-humidity | |
|---|---|---|---|---|---|---|---|---|
| | | | Toner conveying force | Change in image density | Toner conveying force | Change in image density | Toner conveying force | Change in image density |
| | 16 | X-16 | A | C | A | B | A | C |
| | 17 | X-17 | C | A | C | A | B | A |
| | 18 | X-18 | C | B | C | B | C | C |
| | 19 | X-19 | C | A | C | A | B | B |
| | 20 | X-20 | C | A | C | A | B | A |
| | 21 | X-21 | C | A | C | A | C | A |
| | 22 | X-22 | C | A | C | A | C | A |
| | 23 | X-23 | B | B | C | A | A | B |
| | 24 | X-24 | A | C | B | B | A | C |
| | 25 | X-25 | C | A | C | A | B | A |
| | 26 | X-26 | A | A | A | A | A | A |
| | 27 | X-27 | C | A | C | A | B | B |
| | 28 | X-28 | C | A | C | A | B | B |
| | 29 | X-29 | A | A | B | A | A | A |
| | 30 | X-30 | C | A | C | A | B | A |
| | 31 | X-31 | B | A | B | A | A | A |
| | 32 | X-32 | C | A | C | A | B | B |
| | 33 | X-33 | C | A | C | A | B | B |
| | 34 | X-34 | C | A | C | A | B | A |
| | 35 | X-35 | C | A | C | A | B | A |
| | 36 | X-36 | C | A | C | A | C | A |
| | 37 | X-37 | C | A | C | A | B | B |
| | 38 | X-38 | C | A | C | A | C | B |
| | 39 | X-39 | C | A | C | A | C | A |
| | 40 | X-40 | A | A | A | A | A | A |
| | 41 | X-41 | A | A | A | A | A | A |
| | 42 | X-42 | A | A | A | A | A | A |
| | 43 | X-43 | A | B | A | A | A | B |
| | 44 | X-44 | A | B | A | B | A | C |
| | 45 | X-45 | A | A | A | A | A | A |
| | 46 | X-46 | A | C | A | B | A | C |
| | 47 | X-47 | A | A | A | A | A | B |
| | 48 | X-48 | A | A | A | A | A | B |
| | 49 | X-49 | A | A | A | A | A | B |
| | 50 | X-50 | A | A | A | A | A | A |
| Comparative Example | 1 | Y-1 | B | D | C | D | B | D |
| | 2 | Y-2 | D | A | D | A | D | A |
| | 3 | Y-3 | D | A | D | A | D | A |
| | 4 | Y-4 | C | D | C | D | B | D |
| | 5 | Y-5 | C | D | C | D | B | D |
| | 6 | Y-6 | C | D | C | D | C | D |
| | 7 | Y-7 | D | A | D | A | D | A |
| | 8 | Y-8 | D | A | D | A | D | A |
| | 9 | Y-9 | C | D | C | D | C | D |
| | 10 | Y-10 | D | C | D | B | D | C |

As represented in Table 7, the developing roller of each of Examples 1 to 50, satisfying the configuration of the present disclosure, could allow suppression of the change in image density and a toner conveying force to be simultaneously achieved at high levels.

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-080937, filed Apr. 19, 2018, which is hereby incorporated by reference herein in its entirety.

What is claimed is:

1. A developing roller comprising an electro-conductive substrate and a covering layer on the electro-conductive substrate, the covering layer comprising:

a matrix comprising a binder resin, and an electro-conductive particle dispersed in the matrix, wherein when a current value is measured with scanning of a measurement region of a square of 90 μm×90 μm on an outer surface of the covering layer in a tapping mode with application of a potential difference of 10 V in a thickness direction of the covering layer by a cantilever of a scanning probe microscope, the cantilever having a triangular pyramid-shaped tip, a radius of curvature of the tip of 25 nm and a constant of spring of 42 N/m, in an environment of a temperature of 23° C. and a relative humidity of 50%, an arithmetic mean value of the current value is 300 pA or less, and a standard deviation of the current value is 0.1-fold or less of the current value, wherein when the outer surface of the covering layer is charged by using a corona charger with scanning at a speed of 400 mm/sec in a longitudinal direction of the developing roller, with a potential difference of +8 kV being provided relative to the outer surface of the covering layer and a distance between the outer surface of the covering layer and the corona charger being 1 mm, in an environment of a temperature of 23° C. and a relative humidity of 50%, and since 1 minute after the charging, a potential is measured with scanning of a measurement region of a square of 99 μm×99 μm on the outer surface of the covering layer at a distance between the outer surface of the covering layer and a cantilever of a surface potential measurement apparatus of 5 μm, in an environment of a temperature of 23° C. and a relative humidity of 50%, a standard deviation of the potential is 3.0 V or more, and wherein when a stainless roller having a diameter of 30 mm and a width of 10 mm is located with a surface in a circumferential direction of the stainless roller and a surface in a circumferential direction of the developing roller being opposite to each other so as to allow an axial direction of the stainless roller to be perpendicular to an axial direction of the developing roller, and is allowed to abut at a load so that a pressure applied to the surface of the developing roller is 0.10 MPa, and a current value is measured by applying between the stainless roller and the electro-conductive substrate a potential difference of 10 V while rotating the stainless roller at a speed of 50 mm/sec in the axial direction of the developing roller, in an environment of a temperature of 23° C. and a relative humidity of 50%, at 36 points in the circumferential direction of the developing roller, an arithmetic mean value of a volume resistivity determined from the measured current value is $10^{10}$ Ω·cm or less, and a standard deviation of the volume resistivity is 1-fold or more of the arithmetic mean value of the volume resistivity.

2. The developing roller according to claim 1, wherein the covering layer has a thickness of 3.0 μm or more and 30 μm or less, the electro-conductive particle has a mode value of a sphere volume-equivalent diameter of 3.0 μm or more and 20 μm or less, the electro-conductive particle has an arithmetic mean value of the number thereof stacked in a thickness direction of the covering layer of 3 or less, and a proportion of the electro-conductive particle in a total volume of the covering layer is 20% by volume or more and 45% by volume or less, a potential decay time constant of the matrix is 1.0 minute or more in an environment of a temperature of 23° C. and a relative humidity of 50%, and a nano-indenter hardness of the matrix on the outer surface of the covering layer is 0.1 N/mm$^2$ or more and 3.0 N/mm$^2$ or less in an environment of a temperature of 23° C. and a relative humidity of 50%, a nano-indenter hardness on the electro-conductive particle is 1.0 N/mm$^2$ or more and 10.0 N/mm$^2$ or less, and the nano-indenter hardness on the electro-conductive particle is higher than the nano-indenter hardness of the matrix.

3. The developing roller according to claim 1, wherein the electro-conductive particle is at least one selected from the group consisting of a metal particle, a particle having a surface to which an electro-conductive fine particle is attached, a resin particle encapsulating an electro-conductive fine particle, and a carbon particle.

4. The developing roller according to claim 1, wherein the electro-conductive particle is a carbon particle, and a specific perimeter of the electro-conductive particle is 1.1 or less.

5. The developing roller according to claim 1, wherein the binder resin has any one of or both structures represented by the following formulae (1) and (2), any one of or both structures represented by the following formulae (3) and (4), and a structure represented by the following formula (5):

Formula (1)

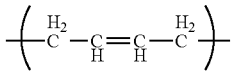

Formula (2)

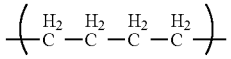

Formula (3)

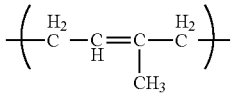

Formula (4)

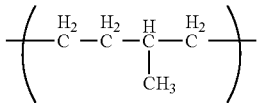

Formula (5)

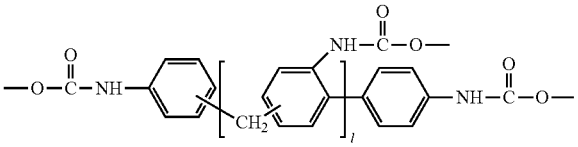

in formula (5), 1 represents an integer of 1 or more.

6. A process cartridge configured to be detachable to a main body of an electrophotographic apparatus, wherein the process cartridge comprises a developing roller, and the developing roller comprises an electro-conductive substrate and a covering layer on the electro-conductive substrate, the covering layer comprising:

a matrix comprising a binder resin; and an electro-conductive particle dispersed in the matrix, wherein when a current value is measured with scanning of a measurement region of a square of 90 μm×90 μm on an outer surface of the covering layer in a tapping mode with application of a potential difference of 10 V in a thickness direction of the covering layer by a cantilever of a scanning probe microscope, the cantilever having a triangular pyramid-shaped tip, a radius of curvature of the tip of 25 nm and a constant of spring of 42 N/m, in an environment of a temperature of 23° C. and a relative humidity of 50%, an arithmetic mean value of the current value is 300 pA or less and a standard deviation of the current value is 0.1-fold or less of the current value, wherein when the outer surface of the covering layer is charged using a corona charger with scanning at a speed of 400 mm/sec in a longitudinal direction of the developing roller, with a potential difference of +8 kV being provided relative to the outer surface of the covering layer and a distance between the outer surface of the covering layer and the corona charger being 1 mm, in an environment of a temperature of 23° C. and a relative humidity of 50%, and since 1 minute after the charging, a potential is measured with scanning of a measurement region of a square of 99 μm×99 μm on the outer surface of the covering layer at a distance between the outer surface of the covering layer and a cantilever of a surface potential measurement apparatus of 5 μm, in an environment of a temperature of 23° C. and a relative humidity of 50%, a standard deviation of the resulting potential is 3.0 V or more, and wherein when a stainless steel roller having a diameter of 30 mm and a width of 10 mm is located with a surface in a circumferential direction of the stainless steel roller and a surface in a circumferential direction of the developing roller being opposite to each other so as to allow an axial direction of the stainless steel roller to be perpendicular to an axial direction of the developing roller, and is allowed to abut at a load so that a pressure applied to the surface of the developing roller is 0.10 MPa, and a current value is measured by applying between the stainless steel roller and the electro-conductive substrate a potential difference of 10 V while rotating the stainless roller at a speed of 50 mm/sec in the axial direction of the developing roller, in an environment of a temperature of 23° C. and a relative humidity of 50%, at 36 points in the circumferential direction of the developing roller, an arithmetic mean value of a volume resistivity determined from the measured current value is $10^{10}$ Ω·cm or less, and a standard deviation of the volume resistivity is 1-fold or more the arithmetic mean value of the volume resistivity.

7. An electrophotographic image forming apparatus comprising a photosensitive member and a developing roller that feeds a developer to an electrostatic latent image formed on the photosensitive member, wherein the developing roller comprises an electro-conductive substrate and a covering layer on the electro-conductive substrate, the covering layer comprising:

a matrix comprising a binder resin, and an electro-conductive particle dispersed in the matrix, wherein when a current value is measured with scanning of a measurement region of a square of 90 μm×90 μm on an outer surface of the covering layer in a tapping mode with application of a potential difference of 10 V in a thickness direction of the covering layer by a cantilever of a scanning probe microscope, the cantilever having a triangular pyramid-shaped tip, a radius of curvature of the tip of 25 nm and a constant of spring of 42 N/m, in an environment of a temperature of 23° C. and a relative humidity of 50%, an arithmetic mean value of the current value is 300 pA or less, and a standard deviation of the current value is 0.1-fold or less of the current value, wherein when the outer surface of the covering layer is charged by using a corona charger with scanning at a speed of 400 mm/sec in a longitudinal direction of the developing roller, with a potential difference of +8 kV being provided relative to the outer surface of the covering layer and a distance between the outer surface of the covering layer and the corona charger being 1 mm, in an environment of a temperature of 23° C. and a relative humidity of 50%, and since 1 minute after the charging, a potential is measured with scanning of a measurement region of a square of 99 μm×99 μm on the outer surface of the covering layer at a distance between the outer surface of the covering layer and a cantilever of a surface potential measurement apparatus of 5 μm, in an environment of a temperature of 23° C. and a relative humidity of 50%, a standard deviation of the potential is 3.0 V or more, and wherein when a stainless roller having a diameter of 30 mm and a width of 10 mm is located with a surface in a circumferential direction of the stainless roller and a surface in a circumferential direction of the developing roller being opposite to each other so as to allow an axial direction of the stainless roller to be perpendicular to an axial direction of the developing roller, and is allowed to abut at a load so that a pressure applied to the surface of the developing roller is 0.10 MPa, and a current value is measured by applying between the stainless roller and the electro-conductive substrate a potential difference of 10 V while rotating the stainless roller at a speed of 50 mm/sec in the axial direction of the developing roller, in an environment of a temperature of 23° C. and a relative humidity of 50%, at 36 points in the circumferential direction of the developing roller, an arithmetic mean value of a volume resistivity determined from the measured current value is $10^{10}$ Ω·cm or less, and a standard deviation of the volume resistivity is 1-fold or more of the arithmetic mean value of the volume resistivity.

* * * * *